US007834261B2

(12) United States Patent
Yasushi et al.

(10) Patent No.: US 7,834,261 B2
(45) Date of Patent: Nov. 16, 2010

(54) MUSIC COMPOSITION REPRODUCING DEVICE AND MUSIC COMPOSITION REPRODUCING METHOD

(75) Inventors: Mitsuo Yasushi, Saitama (JP); Masatoshi Yanagidaira, Saitama (JP); Takehiko Shioda, Saitama (JP); Shinichi Gayama, Saitama (JP); Haruo Okada, Tokyo (JP)

(73) Assignee: Pioneer Corporation, Tokyo (JP)

( * ) Notice: Subject to any disclaimer, the term of this patent is extended or adjusted under 35 U.S.C. 154(b) by 280 days.

(21) Appl. No.: 11/992,664

(22) PCT Filed: Sep. 25, 2006

(86) PCT No.: PCT/JP2006/318914

§ 371 (c)(1),
(2), (4) Date: Mar. 27, 2008

(87) PCT Pub. No.: WO2007/040068

PCT Pub. Date: Apr. 12, 2007

(65) Prior Publication Data

US 2009/0293706 A1 Dec. 3, 2009

(30) Foreign Application Priority Data

Sep. 30, 2005 (JP) ..... 2005-287562

(51) Int. Cl.
*G10H 1/00* (2006.01)

(52) U.S. Cl. ..... 84/609; 84/637; 84/669

(58) Field of Classification Search ..... 84/609, 84/613, 637, 638, 649, 650, 669
See application file for complete search history.

(56) References Cited

U.S. PATENT DOCUMENTS

| | | | | | |
|---|---|---|---|---|---|
| 5,214,993 | A * | 6/1993 | Konishi | 84/637 |
| 5,302,777 | A * | 4/1994 | Okuda et al. | 84/637 |
| 5,440,756 | A * | 8/1995 | Larson | 704/278 |
| 5,641,928 | A * | 6/1997 | Tohgi et al. | 84/613 |
| 5,898,120 | A * | 4/1999 | Kira | 84/638 |
| 5,973,253 | A * | 10/1999 | Hirata | 84/609 |
| 6,051,771 | A * | 4/2000 | Iizuka | 84/622 |
| 6,057,502 | A * | 5/2000 | Fujishima | 84/637 |
| 6,166,316 | A * | 12/2000 | Takahashi et al. | 84/619 |
| 6,177,625 | B1 * | 1/2001 | Ito et al. | 84/613 |
| 6,417,437 | B2 * | 7/2002 | Aoki | 84/611 |

FOREIGN PATENT DOCUMENTS

| | | |
|---|---|---|
| JP | 8-198058 A | 8/1996 |
| JP | 11-109985 A | 4/1999 |
| JP | 2001-188541 A | 7/2001 |
| JP | 2002-229561 A | 8/2002 |
| JP | 2004-045902 A | 2/2004 |
| JP | 2004-254750 A | 9/2004 |

* cited by examiner

*Primary Examiner*—David S. Warren
(74) *Attorney, Agent, or Firm*—Foley & Lardner LLP

(57) ABSTRACT

First, an extracting unit extracts chord progression of a tune to be reproduced. Then, a timing detector detects the timing of variation of the chord progression extracted by the extracting unit. Subsequently, an add-tone reproducing unit combines an add-tone with the tune to be reproduced according to the timing detected by the timing detector. The add-tone reproducing unit can also move a sound image to reproduce the tune or reproduce the tune as an arpeggio.

12 Claims, 19 Drawing Sheets

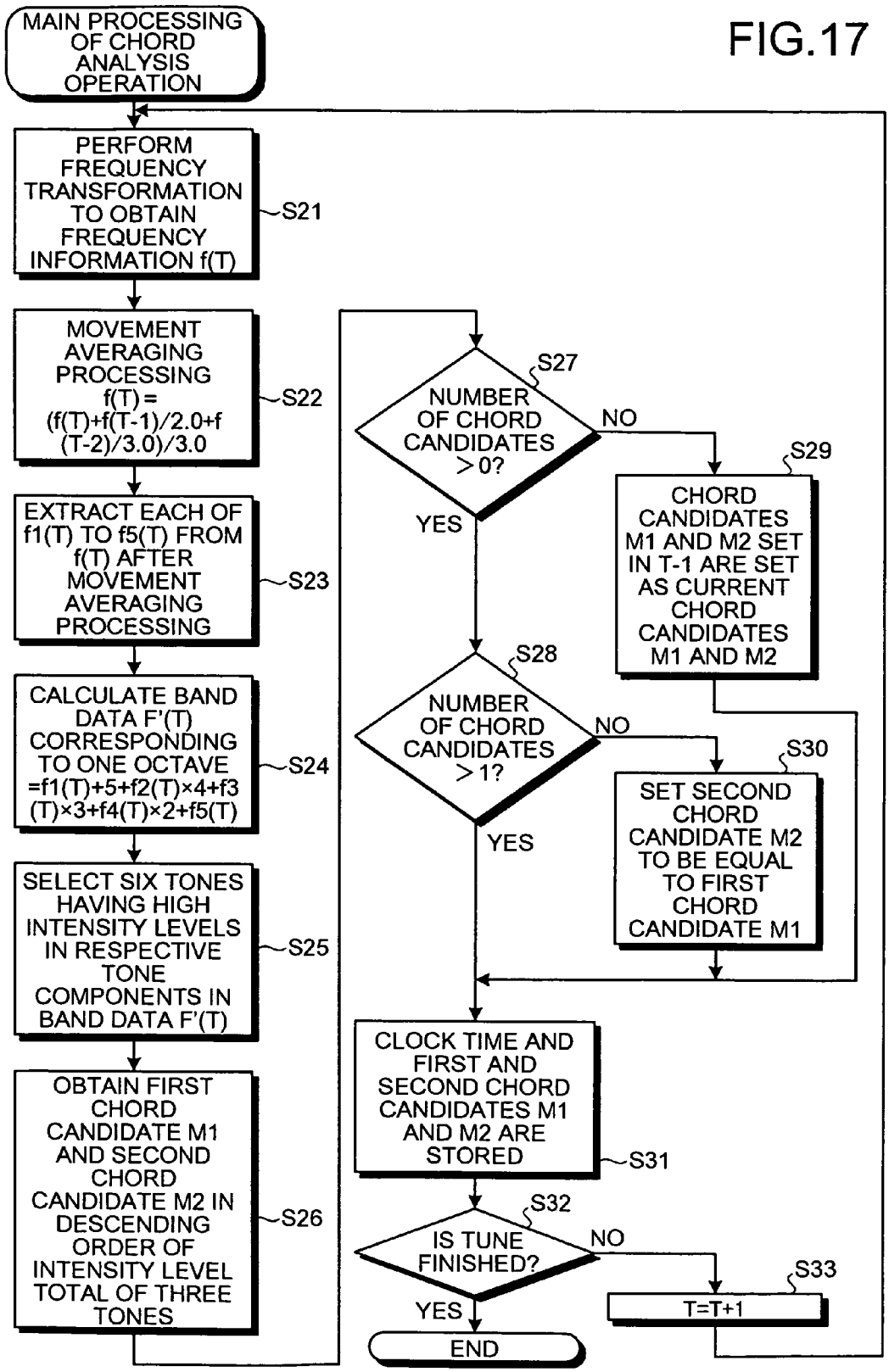
FIG.17
MAIN PROCESSING OF CHORD ANALYSIS OPERATION
PERFORM FREQUENCY TRANSFORMATION TO OBTAIN FREQUENCY INFORMATION f(T)
S21
MOVEMENT AVERAGING PROCESSING f(T) = (f(T)+f(T-1)/2.0+f(T-2)/3.0)/3.0
S22
EXTRACT EACH OF f1(T) TO f5(T) FROM f(T) AFTER MOVEMENT AVERAGING PROCESSING
S23
CALCULATE BAND DATA F'(T) CORRESPONDING TO ONE OCTAVE =f1(T)+5+f2(T)×4+f3(T)×3+f4(T)×2+f5(T)
S24
SELECT SIX TONES HAVING HIGH INTENSITY LEVELS IN RESPECTIVE TONE COMPONENTS IN BAND DATA F'(T)
S25
OBTAIN FIRST CHORD CANDIDATE M1 AND SECOND CHORD CANDIDATE M2 IN DESCENDING ORDER OF INTENSITY LEVEL TOTAL OF THREE TONES
S26
NUMBER OF CHORD CANDIDATES > 0?
S27
NO
YES
CHORD CANDIDATES M1 AND M2 SET IN T-1 ARE SET AS CURRENT CHORD CANDIDATES M1 AND M2
S29
NUMBER OF CHORD CANDIDATES > 1?
S28
NO
YES
SET SECOND CHORD CANDIDATE M2 TO BE EQUAL TO FIRST CHORD CANDIDATE M1
S30
CLOCK TIME AND FIRST AND SECOND CHORD CANDIDATES M1 AND M2 ARE STORED
S31
IS TUNE FINISHED?
S32
NO
YES
T=T+1
S33
END A+C+E+G(Am7)
→A+C+E(Am) | C+E+G(C)
A+C+E♭+F#(Adim7)
→A+C+E♭(Adim7 CANDIDATE)|C+E♭+F#(Cdim7 CANDIDATE)
A+C#+E+G(A7)
→A+C#+E(A)|A+C#+G(A7 CANDIDATE)|C#+E+G(C#dim7 CANDIDATE)
A+C+E+G+B(Am7.9)
→A+C+E(Am) | C+E+G(C) | E+G+B(Em)

MUSIC COMPOSITION REPRODUCING DEVICE AND MUSIC COMPOSITION REPRODUCING METHOD

TECHNICAL FIELD

The present invention relates to a tune reproduction apparatus and a tune reproduction method for reproducing a tune that includes chords. However, use of the present invention is not limited to the tune reproduction apparatus and the tune reproduction method.

BACKGROUND ART

A music reproduction device is used in various environments. For example, when used as an in-vehicle music playing device in a vehicle, the music reproduction device reproduces music during operation of the vehicle. When music is reproduced in such a manner, a user may become drowsy while listening to the music when driving, for example. Meanwhile, among conventional apparatuses that reproduce music, there is one that switches speakers to vary sound localization of the music, thereby obtaining an arousing effect. That is, plural speakers are connected with a sound image controller in advance. Then, the sound image controller reproduces music from a CD player via an amplifier while sequentially changing the order of the target output speakers. Switching the speakers enables the arousing effect to be obtained (see, for example, Patent Document 1).

Patent Document 1: Japanese Patent Application Laid-open No. H8-198058

DISCLOSURE OF INVENTION

Problem to be Solved by the Invention

However, when switching musical signals by switching speakers, the music sounds segmented. Although reproducing music in this manner provides an arousing effect, the intermittent switching of the musical signals is apt to result in an uncomfortable feeling. In particular, for example, there is a problem in that uneasiness occurs when the user is not actually drowsy, and the musical environment is degraded simply to provide an arousing effect.

Means for Solving Problem

A tune reproduction apparatus according to the invention of claim 1 includes an extracting unit that extracts chord progression of a tune to be reproduced; a detecting unit that detects a timing that the chord progression extracted by the extracting unit changes; and an add-tone reproducing unit that reproduces an add-tone by combining the add-tone with the tune and according to the timing detected by the detecting unit, changing a sound image of the add-tone.

Further, a tune reproduction method according to the invention of claim 8 includes an extracting step of extracting chord progression of a tune to be reproduced; a detecting step of detecting a timing that the chord progression extracted at the extracting step changes; and an add-tone reproducing step of reproducing an add-tone by combining the add-tone with the tune and according to the timing detected at the detecting step, changing a sound image of the add-tone.

BRIEF DESCRIPTION OF DRAWINGS

FIG. 17 is a flowchart of the main processing of the chord analysis operation;

EXPLANATIONS OF LETTERS OR NUMERALS

Figure 1:
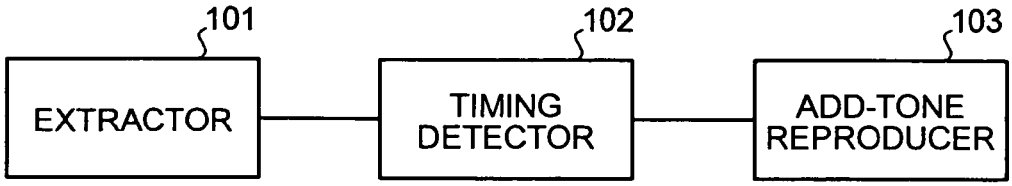
FIG. 1 is a block diagram of a functional structure of a tune reproduction apparatus according an embodiment of the present invention.

101 extractor
102 timing detector
103 add-tone reproducer
301 chord progression extractor
302 timing detector
303 add-tone reproducer
304 add-tone generator
305 mixer
306 amplifier
307 speaker

BEST MODE(S) FOR CARRYING OUT THE INVENTION

Exemplary embodiments of a tune reproduction apparatus and a tune reproducing method according to the present invention are explained in detail below with reference to the accompanying drawings.

FIG. 1 is a block diagram of a functional structure of a tune reproduction apparatus according an embodiment of the present invention. The tune reproduction apparatus according to this embodiment includes an extractor 101, a timing detector 102, and an add-tone reproducer 103.

The extractor 101 extracts chord progression of a tune to be reproduced. The timing detector 102 detects the timing of variation of the chord progression extracted by the extractor 101. The add-tone reproducer 103 combines a tone to be added to the tune, add-tone, with the tune according to the timing detected by the timing detector 102, and reproduces the add-tone combined with the tune, i.e., combined tone. The add-tone reproducer 103 can also change a sound image of the add-tone to be reproduced. The add-tone reproducer 103 can also reproduce a tone constituting the add-tone as an arpeggio.

A pitch of an add-tone may be changed to generate the add-tone according to the chord progression extracted by the extractor 101 and the add-tone reproducer 103 can combine the generated add-tone with the tune and reproduce the combined tone.

A state of drowsiness can be detected, and reproduction of an add-tone can be controlled depending on the detected state of drowsiness. For example, when the onset of drowsiness is detected, the add-tone reproducer 103 can start reproducing the add-tone. When intensification of the drowsiness is detected, the add-tone reproducer 103 can also change frequency characteristics of the add-tone. Further, when an intensification of the drowsiness is detected, the add-tone reproducer 103 can also change the amount that a sound image of the add-tone is moved.

Figure 2:
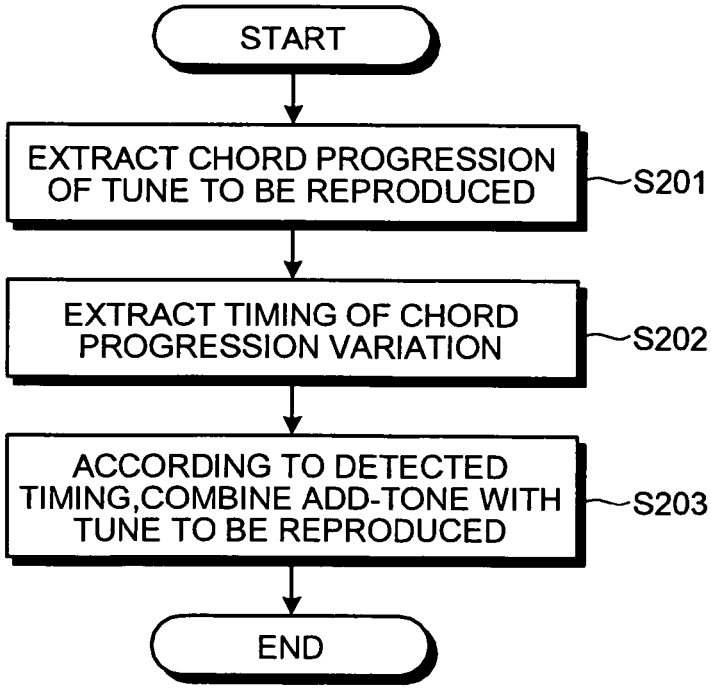
FIG. 2 is a flowchart illustrating processing of a tune reproducing method according to the embodiment of the present invention.

FIG. 2 is a flowchart illustrating processing of a tune reproducing method according to the embodiment of the present invention. First, the extractor 101 extracts chord progression of a tune to be reproduced. (step S201) Next, the timing detector 102 detects a timing of variation of the chord progression extracted by the extractor 101 (step S202). Then, the add-tone reproducer 103 combines an add-tone with the tune according to the timing detected by the timing detector 102, and reproduces the combined tone (step S203).

According to the embodiment described above, a tone that conforms to a tune can be reproduced by combining an add-tone with the tune based on a change in chord progression. Tones having a high arousing effect can be simultaneously output. As a result, the arousing effect can be obtained with a comfortable sound stimulus, and hence, an arousal maintaining effect can be achieved in an environment in which a user is listening to music.

Examples

Figure 3:
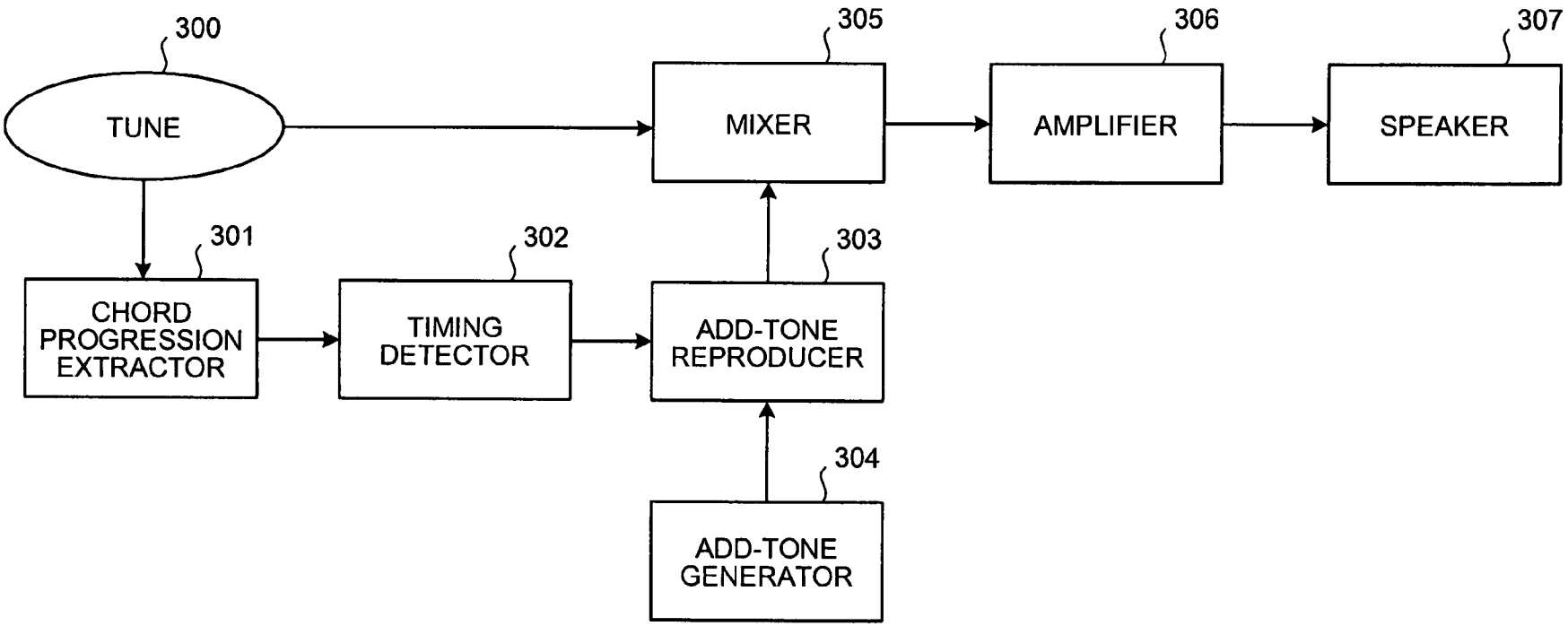
FIG. 3 is a block diagram of a tune reproduction apparatus according to an example of the present invention.

FIG. 3 is a block diagram of a tune reproduction apparatus according to an example of the present invention. The tune reproduction apparatus includes a chord progression extractor 301, a timing detector 302, an add-tone reproducer 303, an add-tone generator 304, a mixer 305, an amplifier 306, and a speaker 307. The tune reproduction apparatus can include a CPU, a ROM, and a RAM. The chord progression extractor 301, the timing detector 302, the add-tone reproducer 303, and add-tone generator 304 can be realized by the CPU using the RAM as a work area and executing programs written in the ROM. The tune reproduction apparatus can achieve an arousal maintaining effect in an environment in which a user is listening to music.

The chord progression extractor 301 reads a tune 300 to extract progression of chords included in the tune 300. As the tune 300 includes a chord portion and a non-chord portion, the chord progression extractor 301 processes the chord portion of the tune 300, and portions other than the chords are input into the mixer 305.

The timing detector 302 detects a point where the chord progression extracted by the chord progression extractor 301 varies. For example, when a chord continuously sounds up to a given time point and another chord sounds from this time point, the chord progression varies at this time point, and hence this time point is detected as a point where the chord progression varies.

The add-tone reproducer 303 reproduces an add-tone with a timing that coincides with a change in the chord progression detected by the timing detector 302. An add-tone to be played is output to the mixer 305. The add-tone generator 304 generates an add-tone and outputs the add-tone to the add-tone reproducer 303. The add-tone reproducer 303 reproduces the add-tone generated by the add-tone generator 304.

The mixer 305 mixes portions of the tune 300 other than the chord progression with the add-tone output from the add-tone reproducer 303, and outputs the mixed tone to the amplifier 306. The amplifier 306 amplifies the tune input thereto and outputs the amplified tune. The amplifier 306 outputs the tune 300 to the speaker 307, and the tune 300 is reproduced from the speaker 307.

Figure 4:
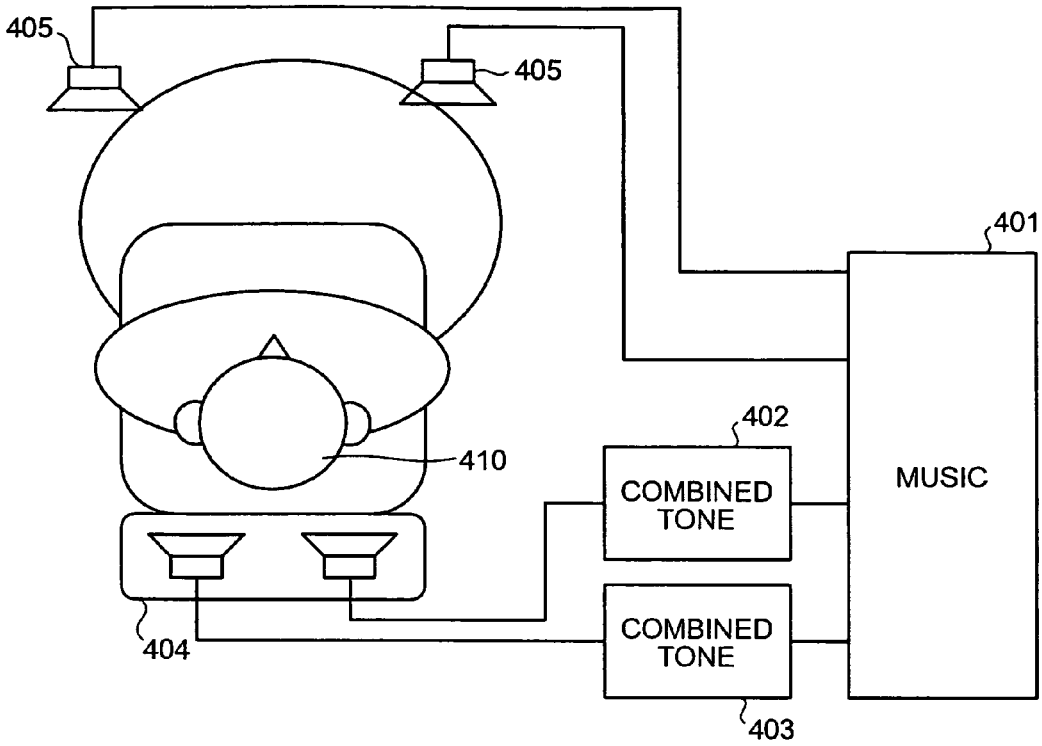
FIG. 4 is an explanatory drawing of a case in which a combined tone is output to a user.

FIG. 4 is an explanatory drawing of a case in which a combined tone is output to a user. First, a tune, music 401, is analyzed to check chords and melody. Then, an add-tone conforming to chord progression is generated, the add-tone is combined with the chords to provide a combined tone, a tone output to a right ear side is output as a combined tone 402, and a tone output to a left ear side is output as a combined tone 403.

The combined tone 402 and the combined tone 403 are generated with a timing that coincides when a change in the chord progression is detected. That is, each tone constituting the chord is reproduced according to the analyzed timing, and the reproduced tone is appropriately allocated to a left ear and a right ear. An add-tone is generated with a timing in which the chord progression varies, and the combined tone 402 and the combined tone 403 are generated and output from a speaker 404. Meanwhile, a portion of music 401 not extracted by the chord progression extractor 302 is output from a front speaker 405.

Therefore, the music 401 is analyzed to extract the chord progression. Then, the combined tone 402 and the combined tone 403 are output according to a change in the chord progression. The add-tone may be a grace note, e.g., an arpeggio (broken chord; as the name suggests, a given chord is arpeggiated and output). That is, it may be a tone like "tum" conforming to music.

As a result, a tone having a high arousing effect is output in a pleasant environment where the arousing effect is achieved with a comfortable sound stimulus without sacrifice of music quality, thereby warding off drowsiness in a pleasant environment. As any music can be used, a user can obtain the arousing effect without becoming bored. The type of sound source may be freely selected.

The type of a sound source can be freely selected from among various sound sources. A frequency of incidence for a sound source to be added may be changed. Frequency, type, sound volume, and sound localization may be changed according to an arousal level. The position of the sound image of a background tone may be changed according to a timing of music. The volume, phase, frequency characteristics, a sense of expanding, etc. of a tone may also be changed.

Figure 5:
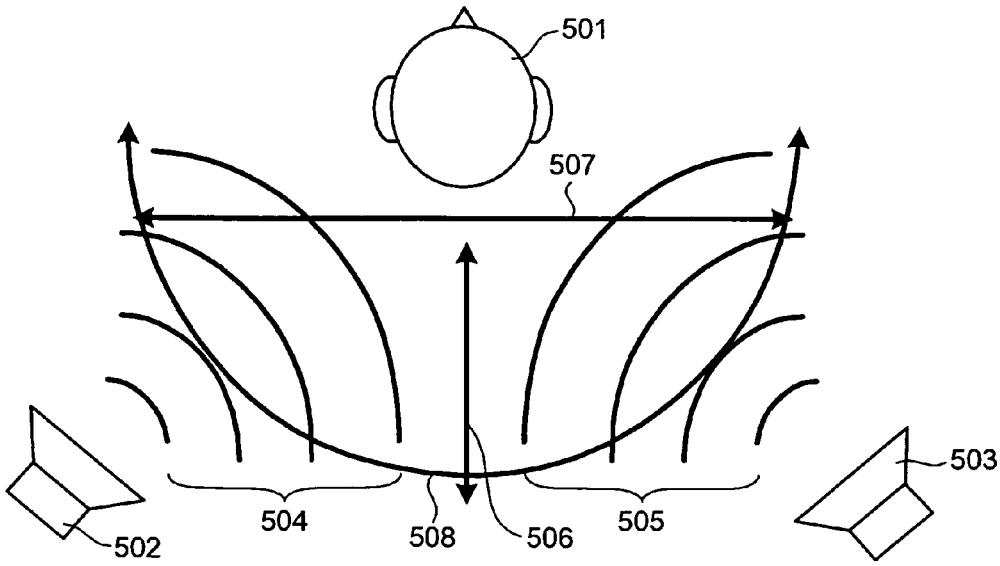
FIG. 5 is an explanatory drawing of an example in which speakers are arranged behind a user.

FIG. 5 is an explanatory drawing of an example in which speakers are arranged behind a user. Although an example in which an add-tone is combined with a tune to be reproduced is explained in FIGS. 3 and 4, here, an example is explained in which a sound image of the add-tone is changed for reproduction. A configuration when a sound image is changed for reproduction is explained hereinafter.

A speaker 502 is placed at a left rear and a speaker 503 is placed at a right rear of a user 501. Music 504 is output from the speaker 502, and music 505 is output from the speaker 503. Changing a balance of sound volumes of the music 504 and the music 505 enables varying the position of the sound image perceived by the user 501.

For example, a sound image can be moved back and forth behind the user 501, as indicated by a direction 506, by changing sound volumes of the music 504 and the music 505 to vary the sound image. The sound image can be also moved in a lateral direction behind the user 501 as indicated by a direction 507. The sound image can be moved to rotate in a clockwise direction or a counterclockwise direction as indicated by a direction 508.

Figure 6:
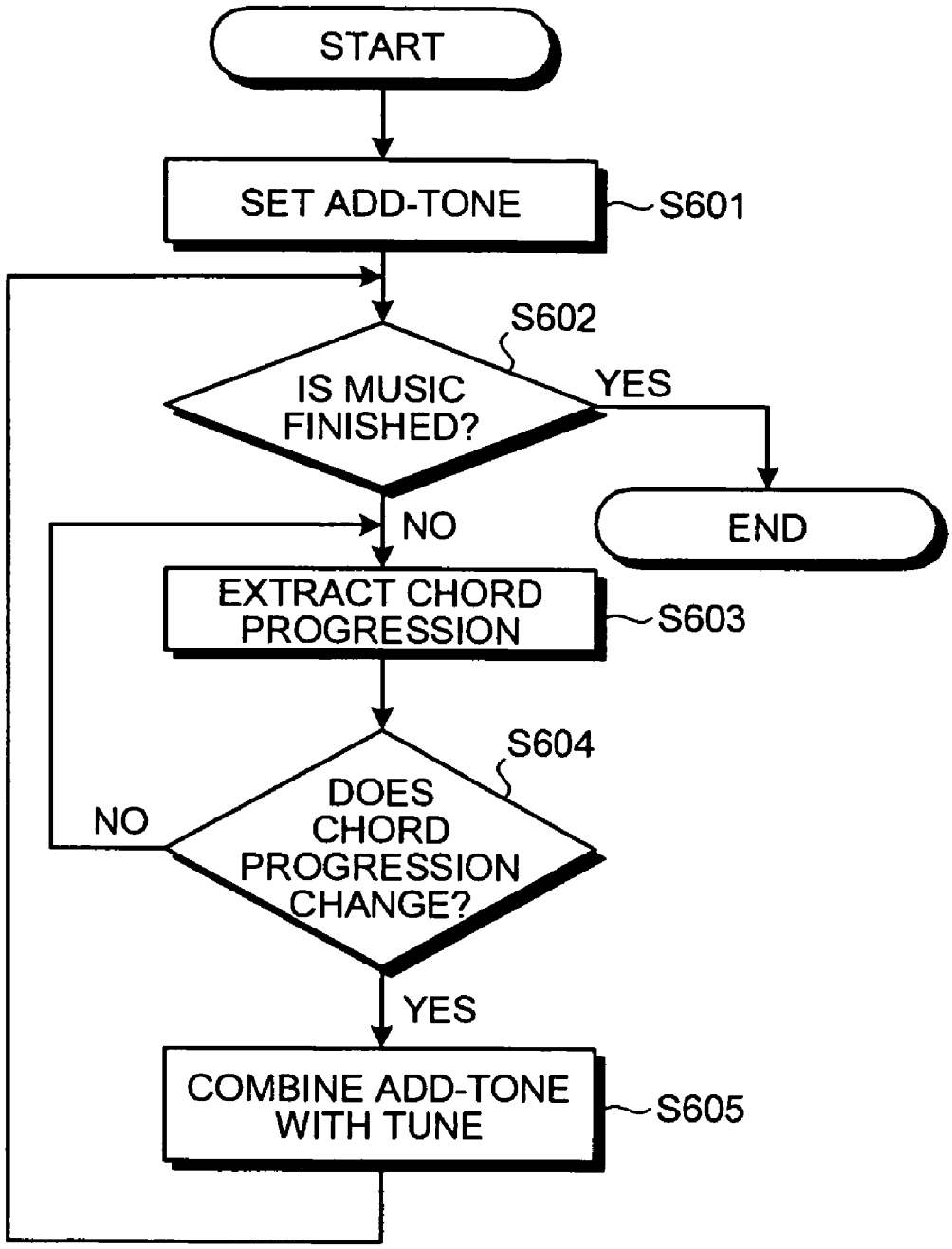
FIG. 6 is a flowchart of tune reproduction processing according to this example.

FIG. 6 is a flowchart of tune reproduction processing according to this example. A series of processing commences when a reproduction of music begins. First, the add-tone reproducer 303 and the add-tone generator 304 set an add-tone (step S601). For example, a tone "tum" is set as the add-tone. Then, whether the music is finished is judged (step S602). If the music is finished (step S602: YES), the series of processing is terminated. If the music is not finished (step S602: NO), chord progression is extracted (step S603). Specifically, time-series data of the music is subjected to frequency analysis to check a change in chords, thereby examining the chord progression.

Then, whether the chord progression varies is judged (step S604). If the chord progression is determined to not vary (step S604: NO), the processing returns to step S603. If the chord progression is determined to vary (step S604: YES), the add-tone is combined with a tune (step S605). For example, a set tone, such as "tum", is combined with the tune. The combined tune is reproduced through the speaker 307. Then, the series of processing is terminated.

Under the discretion of a user, the user may input the tone from an operation panel to perform sound source processing based on an input timing. For example, an input switch can be provided so that the user can tap the switch with, for example, his/her finger in time with the tune. An add-tone is generated as an arousal sound each time the switch is tapped and is combined with the original tune. The tune reproduction apparatus may be operated according to output from a biological sensor. For example, heart rate may be detected at a steering unit in which the respective information is used to generate an arousal sound when the user becomes drowsy.

In this case, since a user having a tendency of spontaneously enjoying the tempo of a tune can follow along as if he/she is playing a musical instrument, enjoyment is enhanced and his/her brain is stimulated, thus resulting in an advantage in that an arousing effect can be further achieved. Since an effect of wontedness does not occur, the user does not easily become drowsy.

An incidence frequency of a sound source to be added may be changed. Frequency, type, sound volume, and sound localization may be changed according to an arousal level. A tone of an arousing sound or position of the sound image and a displacement method thereof may be specially changed. Differing from a warning in a conventional technology, an effect of safe driving using both hands can be achieved without making the driver uncomfortable. As to the arousal sound, a frequency of a type or a timing of a sound source may be increased according to a level of drowsiness.

Figure 7:
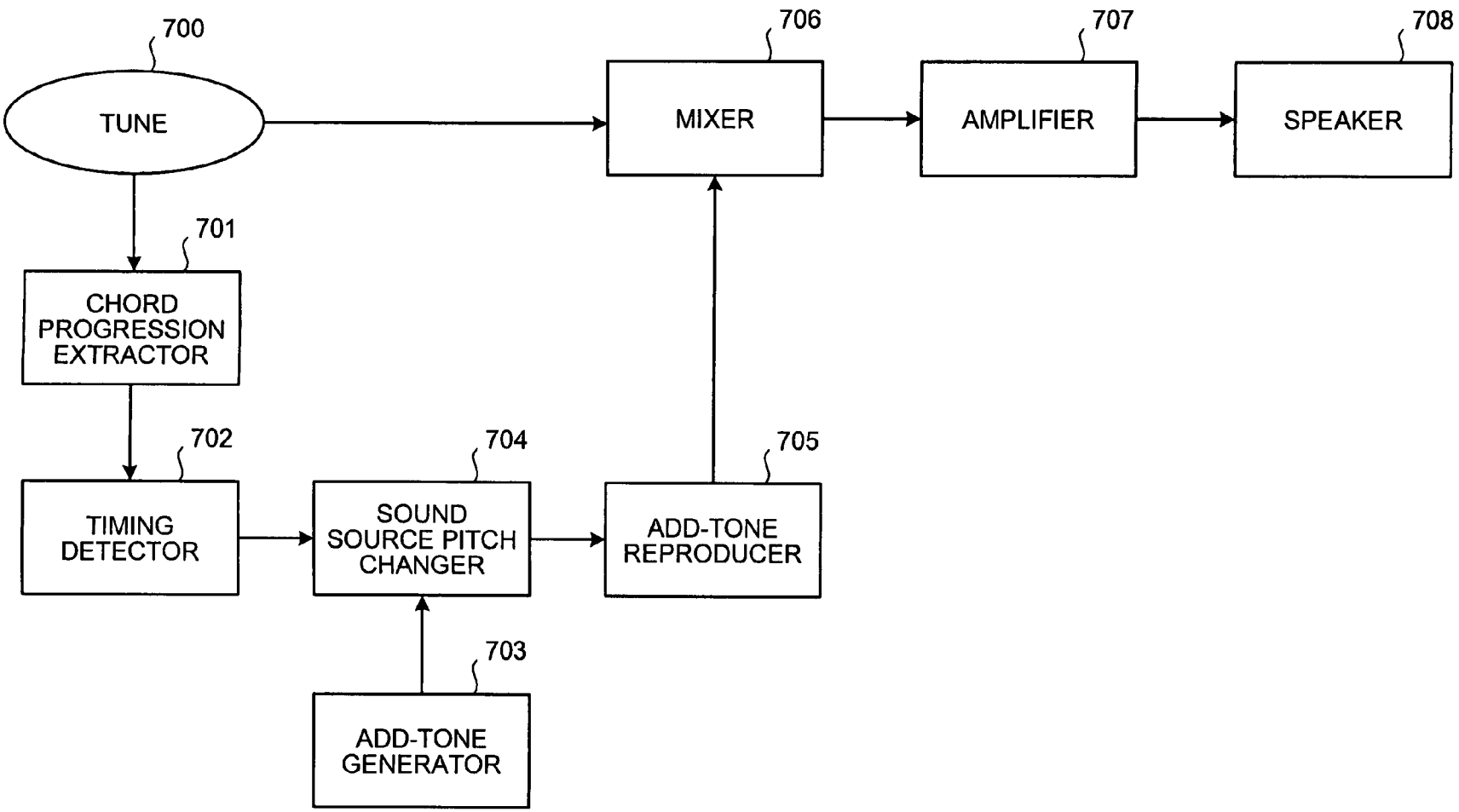
FIG. 7 is a block diagram of a tune reproduction apparatus that reproduces an add-tone having a changed pitch.

FIG. 7 is a block diagram of a tune reproduction apparatus that reproduces an add-tone having a changed pitch. This tune reproduction apparatus includes a chord progression extractor 701, a timing detector 702, an add-tone generator 703, a sound source pitch changer 704, an add-tone reproducer 705, a mixer 706, an amplifier 707, and a speaker 708. This tune reproduction apparatus may include a CPU, a ROM, and a RAM. The add-tone generator 703, the sound source pitch changer 704, and the add-tone reproducer 705 can be realized by the CPU using the RAM as a work area and executing programs written in the ROM.

The chord progression extractor 701 reads a tune 700 to extract chord progression included in the tune 700. As the tune 700 includes a chord portion and a non-chord portion, the chord progression extractor 701 processes the chord portion of the tune 700, and portions other than the chords are input into the mixer 706.

The timing detector 702 detects a point where the chord progression extracted by the chord progression extractor 701 varies. For example, when a chord continuously sounds up to a given time point and another chord sounds from this time point, the chord progression varies at this time point, and hence this time point is detected as a point where the chord progression varies.

The add-tone generator 703 generates an add-tone. The sound source pitch changer 704 changes a pitch of the add-tone generated by the add-tone generator 703. The add-tone having a pitch changed by the sound source pitch changer 704 is supplied to the add-tone reproducer 705, and the add-tone reproducer 705 reproduces the supplied add-tone and inputs the add-tone into the mixer 706 when the timing detector 302 detects a change in chord progression.

The mixer 706 mixes a portion of the tune 700 other than the chord progression with the add-tone output from the add-tone reproducer 705, and outputs the mixed tone to the amplifier 707. The amplifier 707 amplifies the tune input thereto and outputs the amplified tune. The amplifier 707 outputs the tune 700 to the speaker 708, and the tune 700 is reproduced from the speaker 708.

Figure 8:
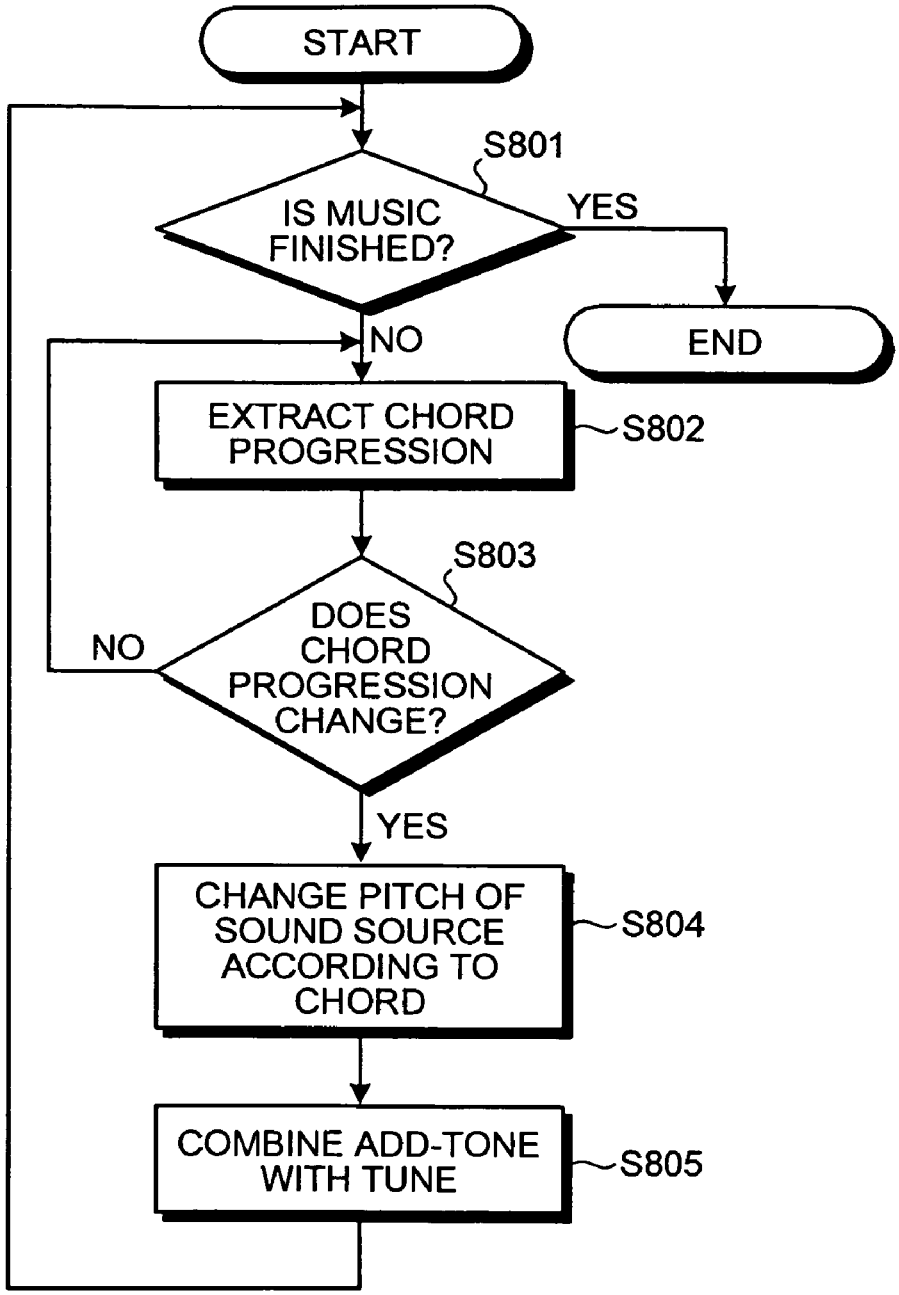
FIG. 8 is a flowchart of tune reproduction processing for reproducing the add-tone having a changed pitch.

FIG. 8 is a flowchart of tune reproduction processing for reproducing the add-tone having a changed pitch. A series of processing commences when a reproduction of music begins. Here, whether the music is finished is judged (step S801). If the music is finished (step S801: YES), the series of processing is terminated. If the music is not finished, (step S801: NO), chord progression is extracted (step S802). Specifically, time-series data of the music is subjected to frequency analysis to check a change in a chord, thereby examining the chord progression.

Then, whether the chord progression varies is judged (step S803). If the chord progression is determined to not vary (step S803: NO), the processing returns to step S802. If the chord progression is determined to vary (step S803: YES), a pitch of a sound source is changed according to a chord (step S804). Specifically, a pitch of a set tone is changed according to an average level of a frequency of a chord, thereby changing the frequency. Then, the add-tone is combined with a tune (step S805). This combined tune is reproduced through the speaker 708. Then, the series of processing is terminated.

Figure 9:
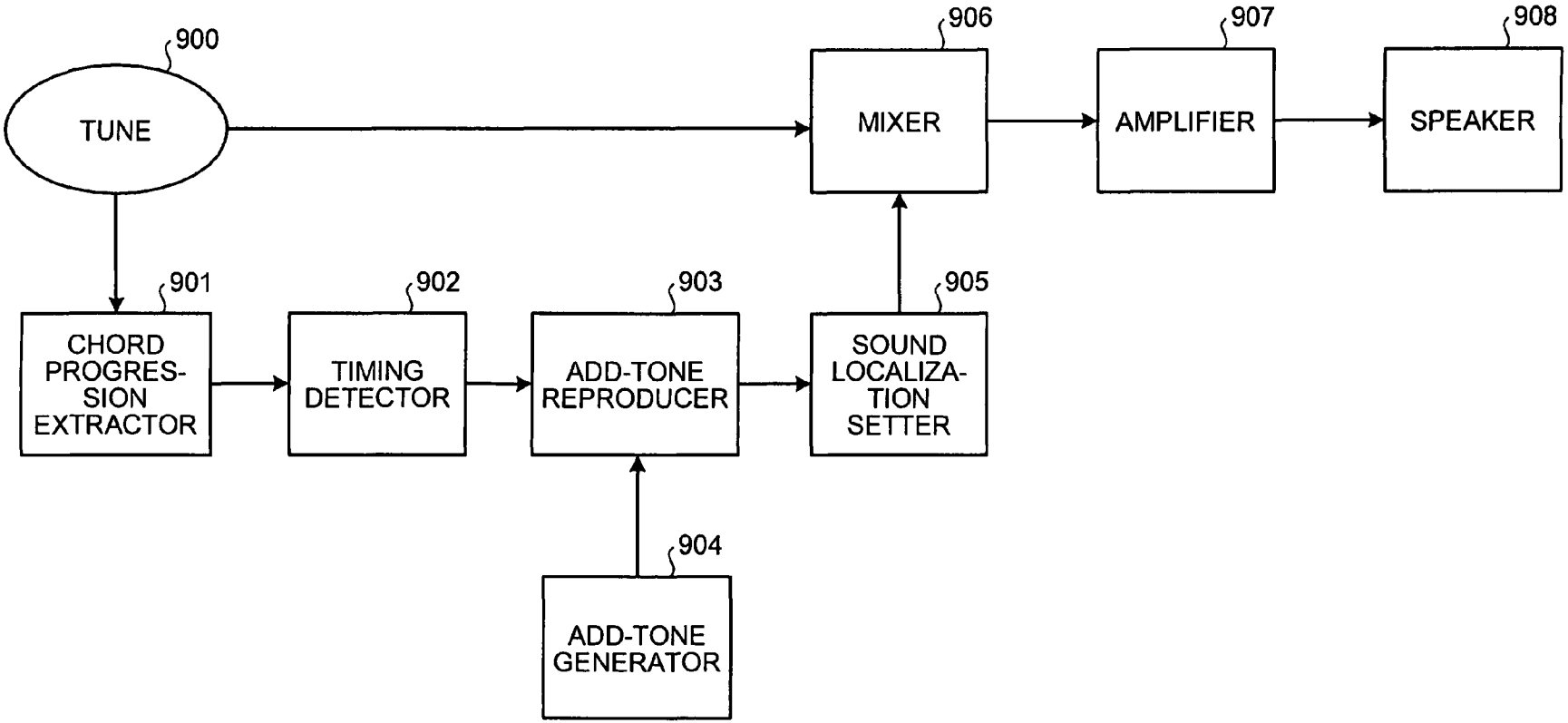
FIG. 9 is a block diagram of a tune reproduction apparatus that changes a sound image of the add-tone for reproduction.

FIG. 9 is a block diagram of a tune reproduction apparatus that changes a sound image of the add-tone for reproduction. The tune reproduction apparatus includes a chord progression extractor 901, a timing detector 902, an add-tone reproducer 903, an add-tone generator 904, sound localization setter 905, a mixer 906, an amplifier 907, and a speaker 908. The tune reproduction apparatus can include a CPU, a ROM, and a RAM. The chord progression extractor 901, the timing detector 902, the add-tone reproducer 903, and the add-tone generator 904 can be realized by the CPU using the RAM as a work area and executing programs written in the ROM.

The chord progression extractor 901 reads a tune 900 to extract progression of chords included in the tune 900. As the tune 900 includes a chord portion and a non-chord portion, the chord progression extractor 901 processes the chord portion of the tune 900, and portions other than the chords are input into the mixer 906.

The timing detector 902 detects a point where the chord progression extracted by the chord progression extractor 901 varies. For example, when a chord continuously sounds up to a given time point and another chord sounds from this time point, the chord progression varies at this time point, and hence this time point is detected as a point where the chord progression varies.

The add-tone reproducer 903 reproduces an add-tone with a timing that coincides with a change in the chord progression detected by the timing detector 902. An add-tone to be played is output to the mixer 906. The add-tone generator 904 generates an add-tone and outputs the add-tone to the add-tone reproducer 903. The add-tone reproducer 903 reproduces the add-tone generated by the add-tone generator 904.

The sound localization setter 905 sets sound localization of an add-tone. Changing a setting of the sound localization enables varying the sound image position of the add-tone. Since the sound image position is moved, the tone can be reproduced for a listener as if the tone is moving. The sound localization can be changed as depicted in FIG. 5. The add-tone having the set sound localization is output to a mixer 906.

The mixer 906 mixes a portion of the tune 900 other than the chord progression with the add-tone output from the add-tone reproducer 903, and outputs the mixed tone to the amplifier 907. The amplifier 907 amplifies the tune input thereto and outputs the amplified tune. The amplifier 907 outputs the tune 900 to the speaker 908, and the tune 900 is reproduced from the speaker 908.

Figure 10:
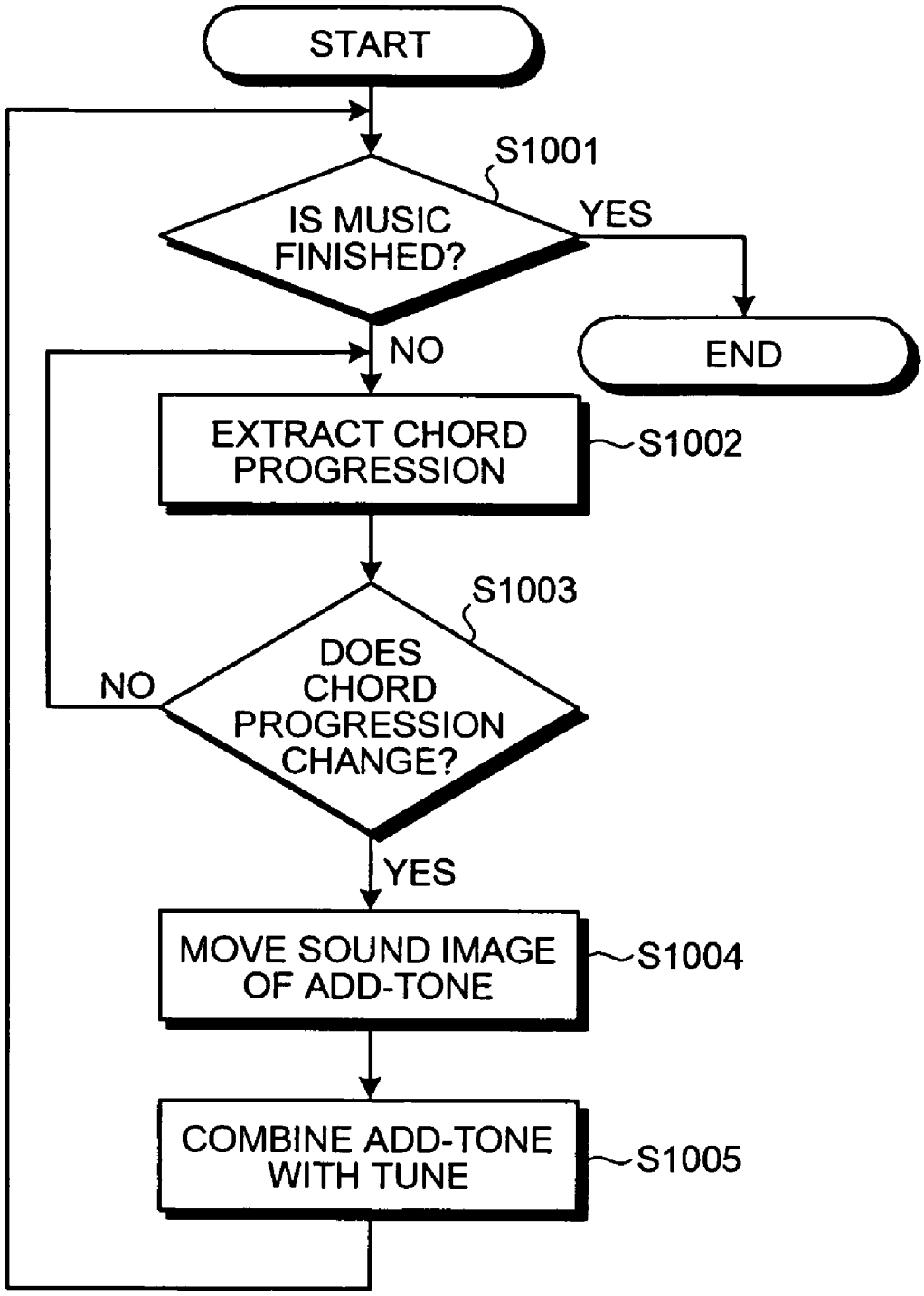
FIG. 10 is a flowchart of tune reproduction processing for changing a sound image of an add-tone to perform reproduction.

FIG. 10 is a flowchart of tune reproduction processing for changing a sound image of an add-tone to perform reproduction. A series of processing commences when a reproduction of music begins. Here, whether the music is finished is judged (step S1001). If the music is finished (step S1001: YES), the series of processing is terminated. If the music is not finished (step S1001: NO), chord progression is extracted (step S1002). Specifically, time-series data of the music is subjected to frequency analysis to check a change in a chord, thereby examining the chord progression.

Subsequently, whether the chord progression varies is judged (step S1003). If the chord progression is determined to not vary (step S1003: NO), the processing returns to step S1002. If the chord progression is determined to vary (step S1003: YES), a sound image of an add-tone is moved (step S1004). For example, sound localization of a set tone is moved from a right-hand side to a left-hand side. Then, the add-tone is combined with a tune (step S1005). The combined tune is reproduced through the speaker 908. Then, the processing returns, to step S1001.

Figure 11:
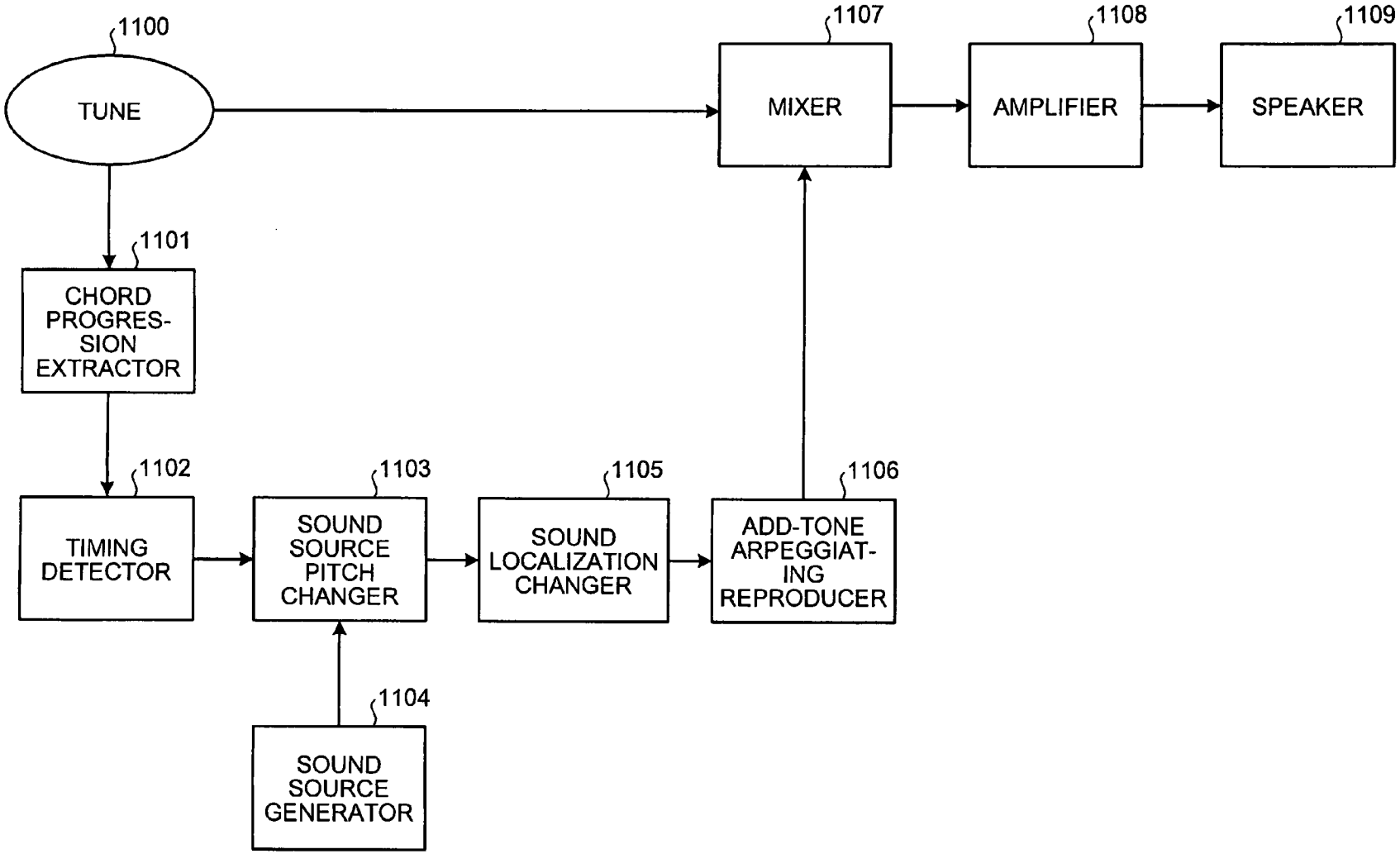
FIG. 11 is a block diagram of a tune reproduction apparatus that changes a sound image of an add-tone and reproduces the add-tone as an arpeggio.

FIG. 11 is a block diagram of a tune reproduction apparatus that changes a sound image of an add-tone and reproduces the add-tone as an arpeggio. This tune reproduction apparatus includes a chord progression extractor 1101, a timing detector 1102, a sound source pitch changer 1103, a sound source generator 1104, a sound localization changer 1105, an add-tone arpeggiating reproducer 1106, a mixer 1107, an amplifier 1108, and a speaker 1109.

This tune reproduction apparatus may include a CPU, an ROM, and an RAM. The chord progression extractor 1101, the timing detector 1102, the sound source pitch changer 1103, the sound source generator 1104, the sound localization changer 1105, and the add-tone arpeggiating reproducer 1106 can be realized by the CPU using the RAM as a work area and executing programs written in the ROM.

The chord progression extractor 1101 reads a tune 1100 to extract chord progression included in a tune 1100. Since the tune 1100 includes a chord portion and a non-chord portion, the chord progression extractor 1101 processes the chord portion in the tune 1100, and portions other than the chord portion is input to the mixer 1107.

The timing detector 1102 detects a point where the chord progression extracted by the chord progression extractor 1101 varies. For example, when a chord continuously sounds up to a given time point and another chord sounds from this time point, the chord progression varies at this time point, and hence this time point is detected as a point where the chord progression varies.

The sound source generator 1104 generates an add-tone. The sound source pitch changer 1103 changes a pitch of the add-tone generated by the sound source generator 1104. The add-tone having the pitch changed by the sound source pitch changer 1103 is supplied to the sound localization changer 1105.

The sound localization changer 1105 changes sound localization of the add-tone. Changing a setting of the sound localization enables varying the sound image position of the add-tone. Since the sound image position is moved, the tone can be reproduced for a listener as if the tone is moving. The add-tone arpeggiating reproducer unit 1106 reproduces the received add-tone in the form of an arpeggio and outputs it to the mixer 1107 with a timing that coincides with the timing of the change in the chord progression detected by the timing detector 1102.

The mixer 1107 mixes a portion of the tune 1100 other than the chord progression with the add-tone output from the add-tone arpeggiating reproducer 1106, and outputs the mixed tone to the amplifier 1108. The amplifier 1108 amplifies the tune input thereto and outputs the amplified tune. The amplifier 1108 outputs the tune 1100 to the speaker 1109, and the tune 1100 is reproduced from the speaker 1109.

Figure 12:
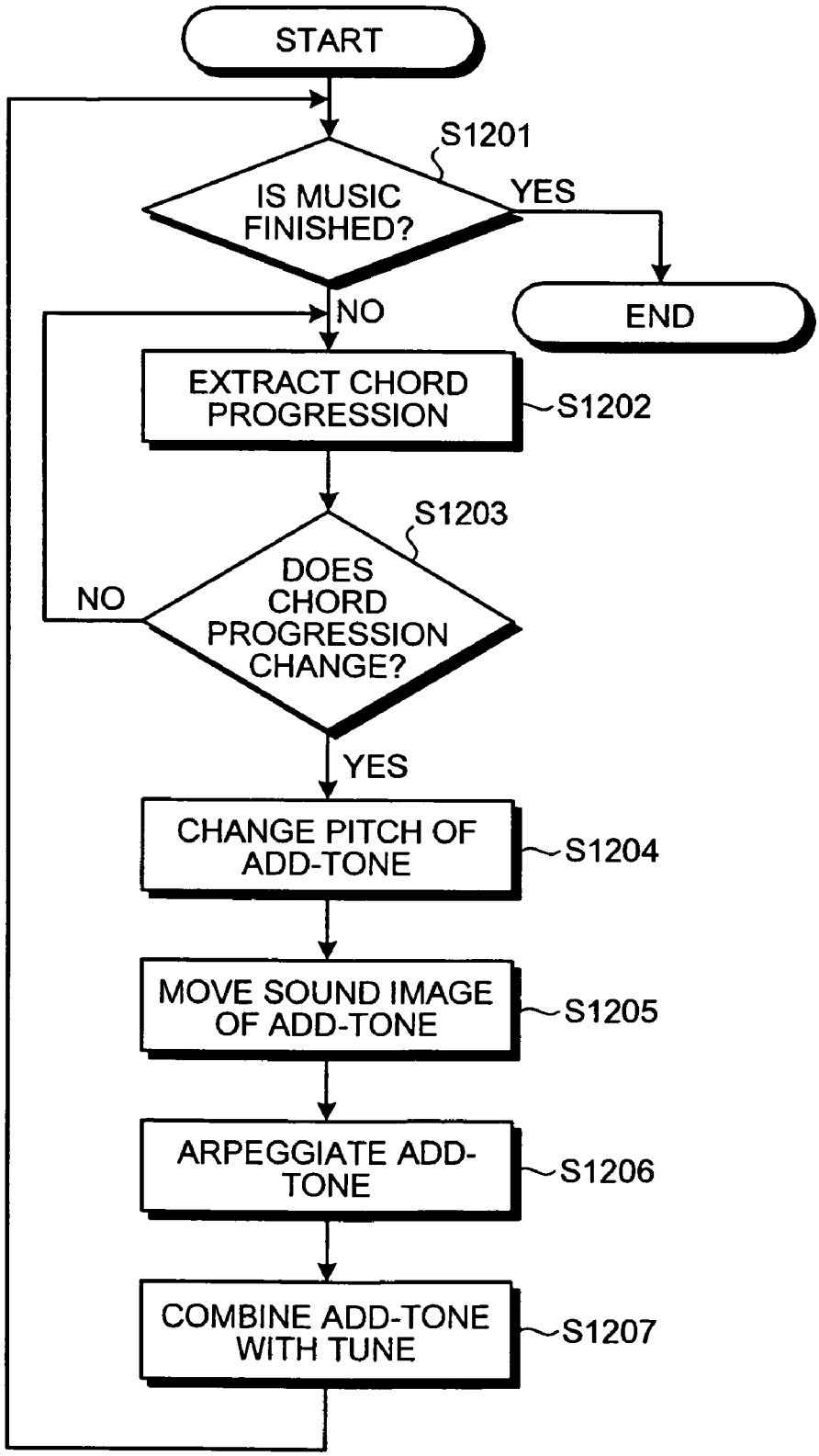
FIG. 12 is a flowchart of tune reproduction processing for reproducing an add-tone having a changed pitch.

FIG. 12 is a flowchart of tune reproduction processing for reproducing an add-tone having a changed pitch. A series of processing commences when a reproduction of music begins. Here, whether the music is finished is judged (step S1201). If the music is finished (step S1201: YES), the series of processing is terminated. If the music is not finished (step S1201: NO), chord progression is extracted (step S1202). Specifically, time-series data of the music is subjected to frequency analysis to check a change in chords, thereby examining the chord progression.

Subsequently, whether the chord progression varies is judged (step S1203). If the chord progression is determined to not vary (step S1203: NO), the processing returns to step S1202. If the chord progression is determined to vary (step S1203: YES), a pitch of an add-tone is changed (step S1204). Then, a sound image of the add-tone is moved (step S1205).

The add-tone is arpeggiated and reproduced (step S1206). For example, tones, such as "do, mi, sol" constituting a chord are not reproduced simultaneously, but are sequentially reproduced. The add-tone is combined with a tune (step S1207). The combined tune is reproduced through the speaker 1109. Then, the processing returns to step S1201.

Figure 13:
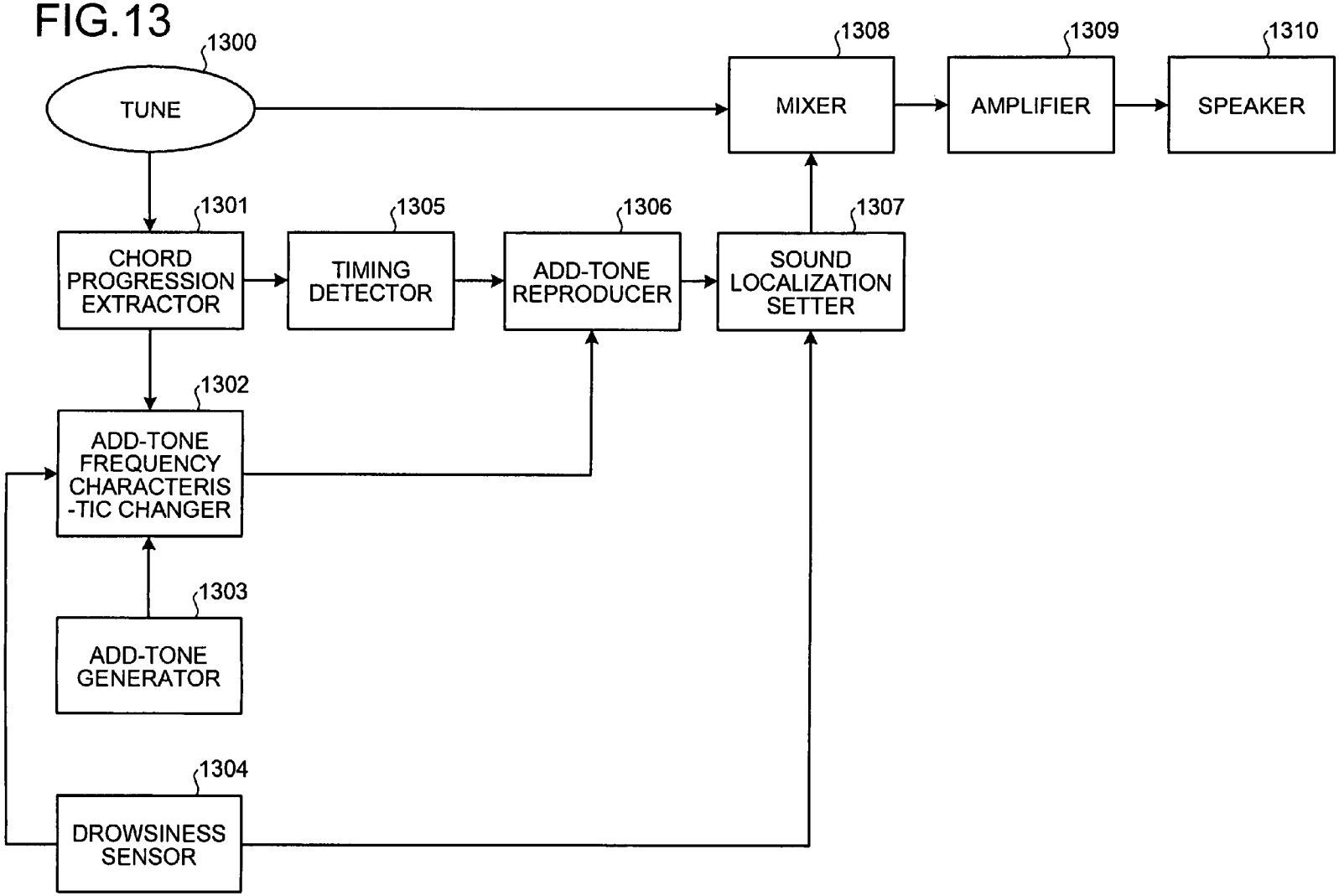
FIG. 13 is a block diagram of a tune reproduction apparatus that reproduces an add-tone according to detected drowsiness.

FIG. 13 is a block diagram of a tune reproduction apparatus that reproduces an add-tone according to detected drowsiness. This tune reproduction apparatus includes a chord progression extractor 1301, an add-tone frequency characteristic changer 1302, an add-tone generator 1303, a drowsiness sensor 1304, a timing detector 1305, an add-tone reproducer 1306, a sound localization setter 1307, a mixer 1308, an amplifier 1309, and a speaker 1310.

The tune reproduction apparatus can include a CPU, a ROM, and a RAM. The chord progression extractor 1301, the timing detector 1305, the add-tone reproducer 1306, and sound localization setter 1307 can be realized by the CPU using the RAM as a work area and executing programs written in the ROM.

The chord progression extractor 1301 reads a tune 1300 to extract chord progression included in the tune 1300. As the tune 1300 includes a chord portion and a non-chord portion, the chord progression extractor 1301 processes the chord portion in the tune 1300, and portions other than the chord portion are input to the mixer 1308.

The add-tone frequency characteristic changer 1302 changes frequency characteristics of an add-tone. For example, when drowsiness of a listener is intensified, the add-tone frequency characteristic changer 1302 changes frequency characteristics of an add-tone by, for example, turning up a tone in a low range or a high range. The add-tone having the changed frequency characteristics is output to the add-tone reproducer 1306. The add-tone generator 1303 generates an add-tone and outputs it to the add-tone frequency characteristic changer 1302. The drowsiness sensor 1304 is a sensor that detects a state of drowsiness. The detected state of drowsiness is output to the add-tone frequency characteristic changer 1302 and the sound localization setter 1307.

The timing detector 1305 detects a point where the chord progression extracted by the chord progression extractor 1301 varies. For example, when a chord continuously sounds up to a given time point and another chord sounds from this time point, the chord progression varies at this time point, and hence this time point is detected as a point where the chord progression varies. The add-tone reproducer 1306 reproduces an add-tone with a timing that coincides with a change in the chord progression detected by the timing detector 1305. The add-tone to be reproduced is output to the sound localization setter 1307.

The sound localization setter 1307 sets sound localization of an add-tone. Changing a setting of the sound localization enables varying the sound image position of the add-tone. Since the sound image position is moved, the tone can be reproduced for a listener as if the tone is moving. The add-tone having the set sound localization is output to the mixer 1308.

The mixer 1308 mixes a portion other than the chord progression in the tune 1300 with the add-tone output from the add-tone reproducer 1306, and outputs the add-tone mixed with the portion to the amplifier 1309. The amplifier 1309 amplifies and outputs the received tune. The amplifier 1309 outputs the tune 1300 to the speaker 1310, and the tune 1300 is reproduced through the speaker 1310.

Figure 14:
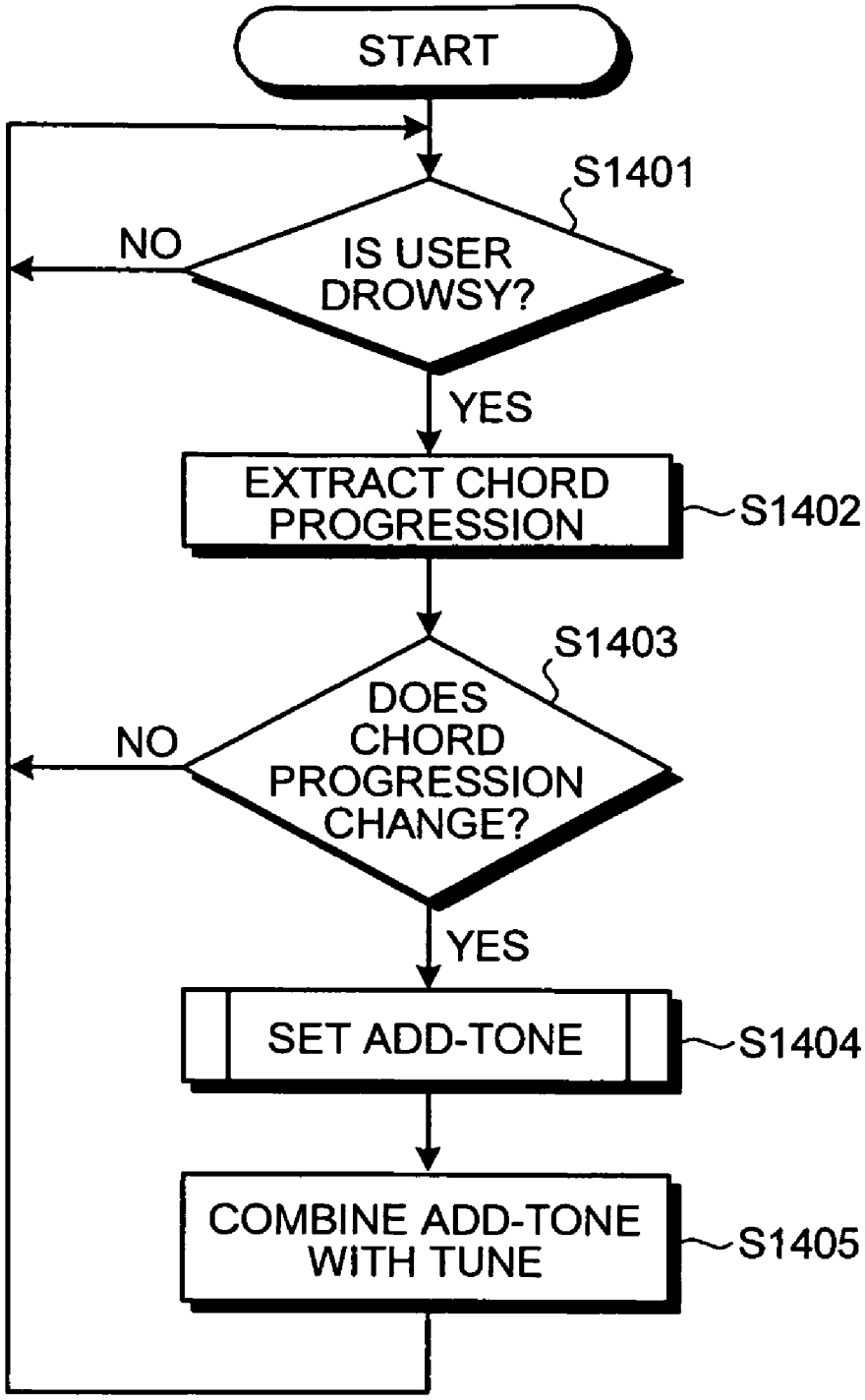
FIG. 14 is a flowchart of tune reproduction processing for reproducing an add-tone according to detected drowsiness.

FIG. 14 is a flowchart of tune reproduction processing for reproducing an add-tone according to detected drowsiness. A series of processing commences when a reproduction of music begins. Here, whether the onset of drowsiness has occurred is judged (step S1401). If the onset of drowsiness has not occurred (step S1401: NO), step S1401 is again repeated. If the onset of drowsiness has occurred (step S1401: YES), chord progression is extracted (step S1402).

Figure 15:
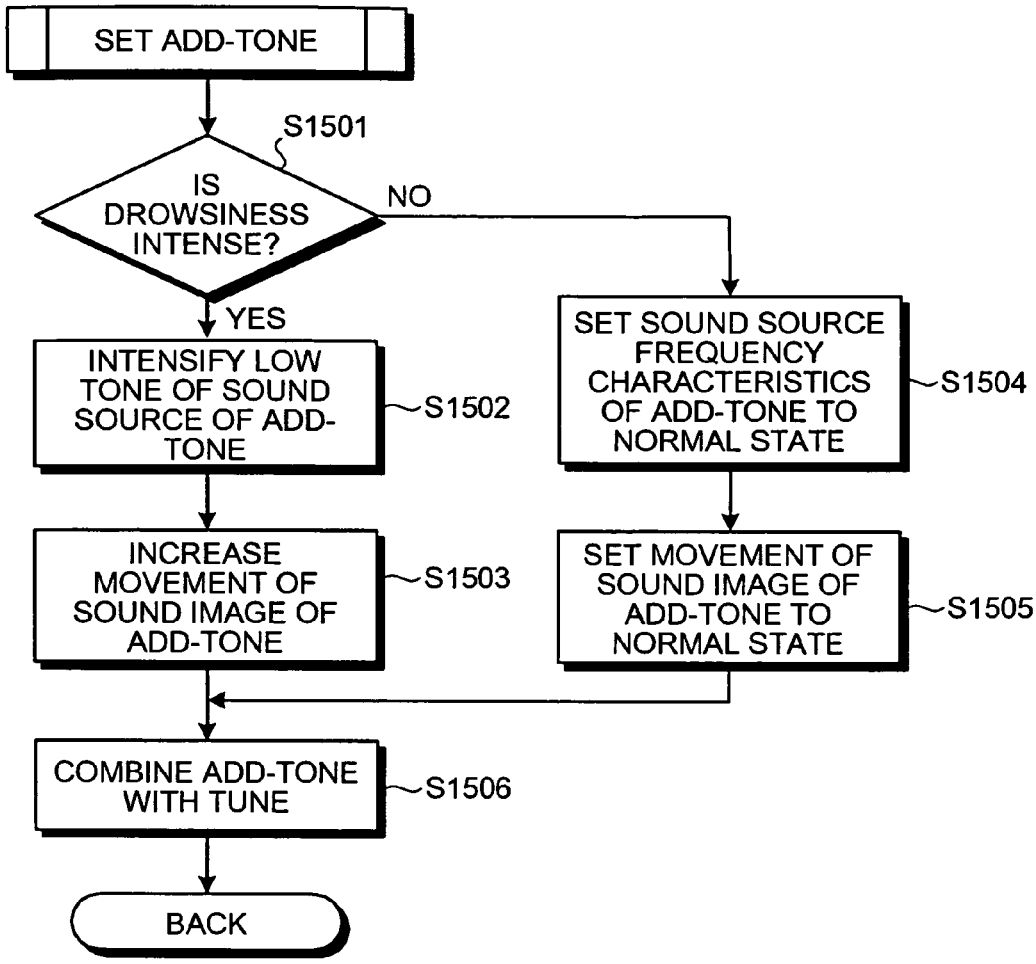
FIG. 15 is a flowchart of processing for setting the add-tone.

Then, whether the chord progression varies is judged (step S1403). If the chord progression is determined to not vary (step S1403: NO), the processing returns to step S1401. If the chord progression is determined to vary (step S1403: YES), processing for setting add-tone depicted in FIG. 15 is executed (step S1404). An add-tone is combined with a tune (step S1405). The combined tune is reproduced through the speaker 1310. Then, the processing returns to step S1401.

FIG. 15 is a flowchart of processing for setting the add-tone. When the processing advances to the processing for setting add-tone at step S1404, whether the detected drowsiness is intense is judged (step S1501). If the drowsiness is determined to be intense (step S1501: YES), a low tone is intensified with respect to a sound source of the add-tone (step S1502). Subsequently, sound image movement of the add-tone is increased (step S1503). Then, the processing advances to step S1506.

When the detected drowsiness is determined to be not intense (step S1501: NO), frequency characteristics are set to a normal (flat) state with respect to the sound source of the add-tone (step S1504). Then, the sound image movement of the add-tone is set to a normal state (step S1505). The processing advances to step S1506.

Subsequently, the add-tone is combined with a tune (step S1506). Since the combined tone having the add-tone combined therewith is generated, the add-tone setting processing at step S1404 depicted in FIG. 14 is terminated, and the processing returns to step S1405.

Processing to achieve an arousing effect by generating a combined tone having an add-tone combined therewith when chord progression varies is explained above. Herein, a mechanism of extracting a change in this chord progression is explained in further detail.

Figure 16:
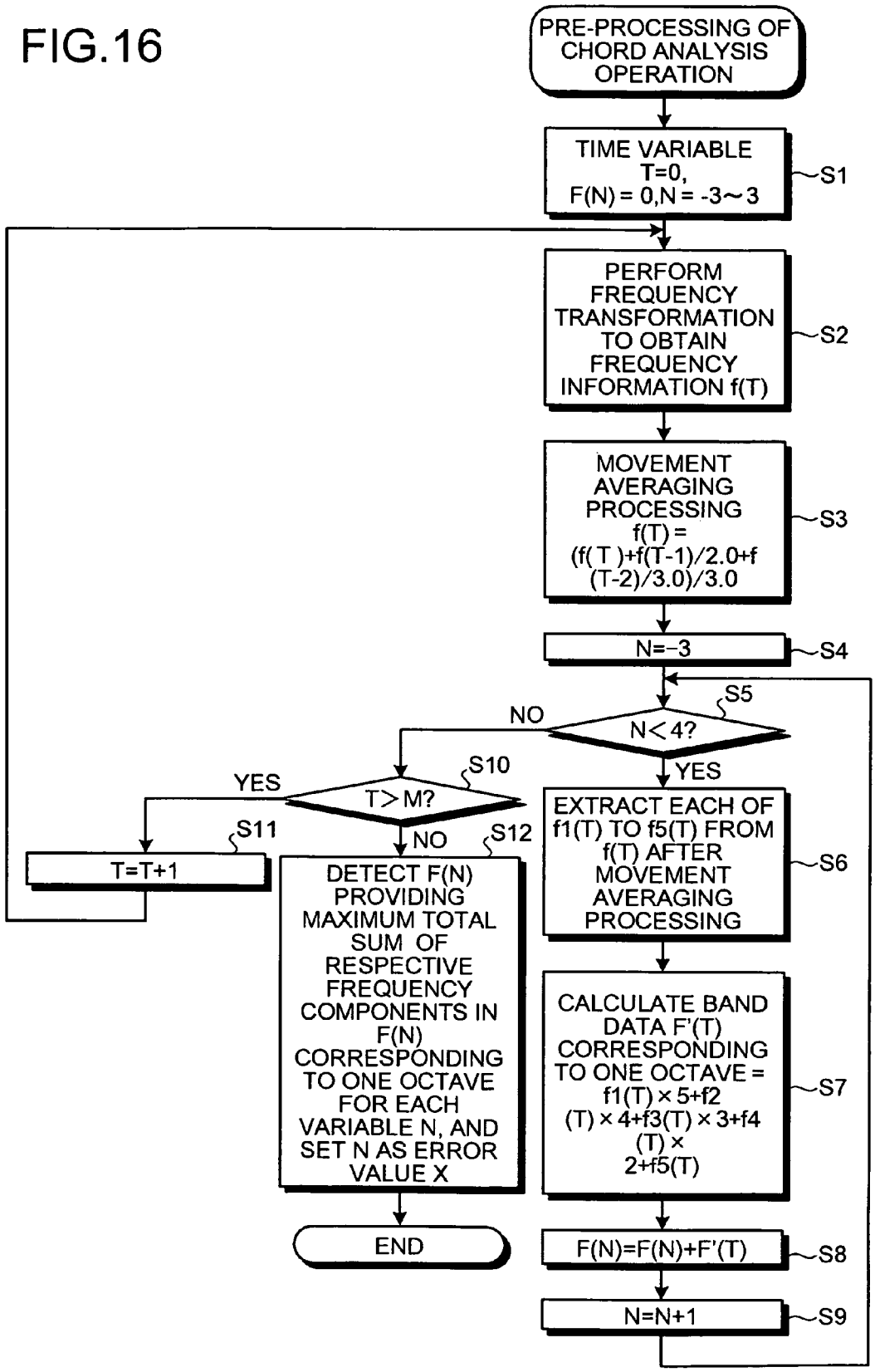
FIG. 16 is a flowchart of a frequency error detecting operation.

FIG. 16 is a flowchart of a frequency error detecting operation. Chord analysis operations include pre-processing, main processing, and post-processing. The frequency error detecting operation corresponds to the pre-processing. First, a time variable T and band data F(N) are initialized to 0, and a range of a variable N is initialized to −3 to 3 (step S1). Subsequently, an input digital signal is subjected to frequency transformation at intervals of 0.2 seconds based on Fourier transformation, thereby obtaining frequency information f(T) (step S2).

Subsequently, current f(T) and previous f(T−1), and f(T−2) before the last are used to perform movement averaging processing (step S3). In this movement averaging processing, frequency information corresponding to the last two times is used on the assumption that a chord rarely varies within 0.6 second. The movement averaging processing is operated by using the following equation.

$$f(T)=(f(T)+f(T-1)/2.0+f(T-2)/3.0)/3.0 \qquad \text{Equation (1)}$$

After execution of step S3, the variable N is set to −3 (step S4), and whether this variable N is smaller than 4 is judged (step S5). When N<4 (step S5: YES), frequency components f1(T) to f5(T) are sequentially extracted from the frequency information f(T) subject to the movement averaging processing (step S6).

The frequency components f1(T) to f5(T) belong to 12 tones in an equal temperament corresponding to each of five octaves with (110.0+2×N) Hz being determined as a fundamental frequency. The 12 tones are A, A#, B, C, C#, D, D#, E, F, F#, G, and G#. If the tone A is 1.0, frequency ratios of the 12 tones and the tone A that is one octave higher are as follows. The tone A of f1(T) has (110.0+2×N) Hz, the tone A of f2(T) has 2×(110.0+2×N) Hz, the tone A of f3(T) has 4×(110.0+2×N) Hz, and the tone A of f4(T) has 8×(110.0+2×N) Hz, and the tone A of f5(T) has 16×(110.0+2×N) Hz.

Then, the frequency components f1(T) to f5(T) are converted into band data F'(T) corresponding to one octave (step S7). The band data F'(T) is represented as $$F'(T)=f1(T)\times 5+f2(T)\times 4+f3(T)x3+f4(T)\times 2+f5(T) \qquad \text{Equation (2).}$$

That is, the frequency components f1(T) to f5(T) are individually weighted and then added. The band data F'(T) corresponding to one octave is added to the band data F(N) (step S8). Thereafter, 1 is added to the variable N (step S9), and step S5 is again executed. The operations at the steps S6 to S9 are repeated as long as N is smaller than 4, i.e., N falls within the range of −3 to +3 at step S5. As a result, the tone component F(N) becomes a frequency component corresponding to one octave including a tone error falling in the range of −3 to +3.

When N≧4 is determined at step S5 (step S5: NO), whether the variable T is larger than a predetermined value M is judged (step S10). When T>M (step S10: YES), 1 is added to the variable T (step S11), and step S2 is again executed. Band data F(N) for each variable N is calculated with respect to the frequency information f(T) obtained from frequency transformation performed M times.

When T≦M is determined at step S10 (step S10: NO), F(N) that provides a maximum sum total of respective frequency components in the band data F(N) corresponding to one octave for each variable N is detected, and N in this detected F(N) is set as an error value X (step S12). When a pitch of the entire music tones, e.g., orchestral performance sounds has a fixed difference from an equal temperament, obtaining the error value X based on this pre-processing enables compensating this difference and executing the later-explained main processing of chord analysis.

FIG. 17 is a flowchart of the main processing of the chord analysis operation. After end of the frequency error detecting operation of the pre-processing, the main processing of the chord analysis operation is executed. When the error value X is already known or its error can be ignored, the pre-processing may be omitted. In the main processing, the processing is executed from a first part in a tune to perform chord analysis with respect to the entire tune.

First, an input digital signal is subjected to frequency transformation at intervals of 0.2 seconds based on Fourier transformation, thereby obtaining frequency information f(T) (step S21). Then, current f(T), previous f(T−1), and f(T−2) before the last are used to execute movement averaging processing (step S22). The steps S21 and S22 are executed like the steps S2 and S3.

After execution of step S22, frequency components f1(T) to f5(T) are respectively extracted from the frequency information f(T) subject to movement averaging processing (step S23). Like step S6, the frequency components f1(T) to f5(T) are 12 tones A, A#, B, C, C#, D, D#, E, F, F#, G, and G# in an equal temperament corresponding to each of five octaves with (110.0+2×N) Hz being determined as a fundamental frequency. The tone A of f1(T) has (110.0+2×N) Hz, the tone A of f2(N) has 2×(110.0+2×N) Hz, the tone A of f3(T) has 4×(110.0+2×N) Hz, the tone A of f4(T) has 8×(110.0+2×N) Hz, and the tone A of f5(T) has 16×(110.0+2×N) Hz. Here, N is X set at step S16.

After execution of step S23, the frequency components f1(T) to f5(T) are converted into band data F'(T) corresponding to one octave (step S24). This step S24 is also executed by using Equation (2) like step S7. The band data F'(T) includes each tone component.

After execution of step S24, six tones having high intensity levels are selected as candidates from the respective tone components in the band data F'(T) (step S25), and two chords M1 and M2 are generated from the six tone candidates (step S26). A chord that uses one tone as a root and includes three tones is generated from the six tones as the candidates. That is, chords in 6C3 combination patterns are considered. Levels of three tones constituting each chord are added, and a chord having a maximum addition result value is determined as a first chord candidate M1, and a chord having the second largest addition result value is determined as a second chord candidate M2.

Figure 18:
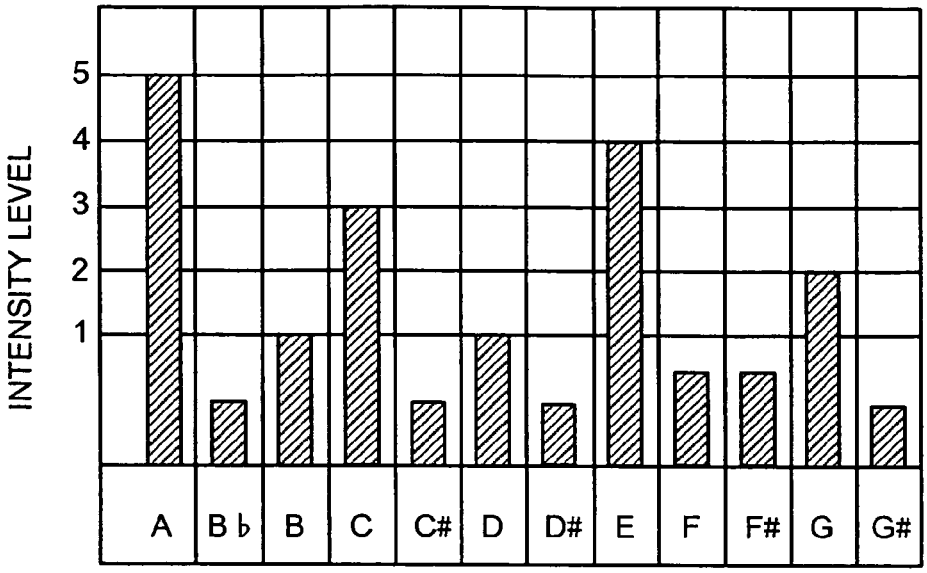
FIG. 18 is an explanatory drawing of a first example of intensity levels with respect to the 12 tones in the band data.

FIG. 18 is an explanatory drawing of a first example of intensity levels with respect to the 12 tones in the band data. When each tone component in the band data F'(T) has a component depicted in FIG. 18, six tones A, E, C, G, B, and D are selected at a step S25. Three chords each generated from three tones in the six tones A, E, C, G, B, and D are, e.g., a chord Am including the (tones A, C, and E), a chord C including (tones C, E, and G), a chord Em including (tones E, B, and G), a chord G including (tones G, B, and D), etc. A total intensity level of the chord Am (tones A, C, and E) is 12, a total intensity level of the chord C (tones C, E, and G) is 9, a total intensity level of the chord Em (tones E, B, and G) is 7, and a total intensity level of the chord G (tones G, B, and D) is 4. Therefore, the chord Am is set as the first chord candidate M1 since the total intensity level 12 of the chord Am is the maximum at step S26, and the chord C is set as the second chord candidate M2 since the total intensity level 9 of the chord C is the second highest.

Figure 19:
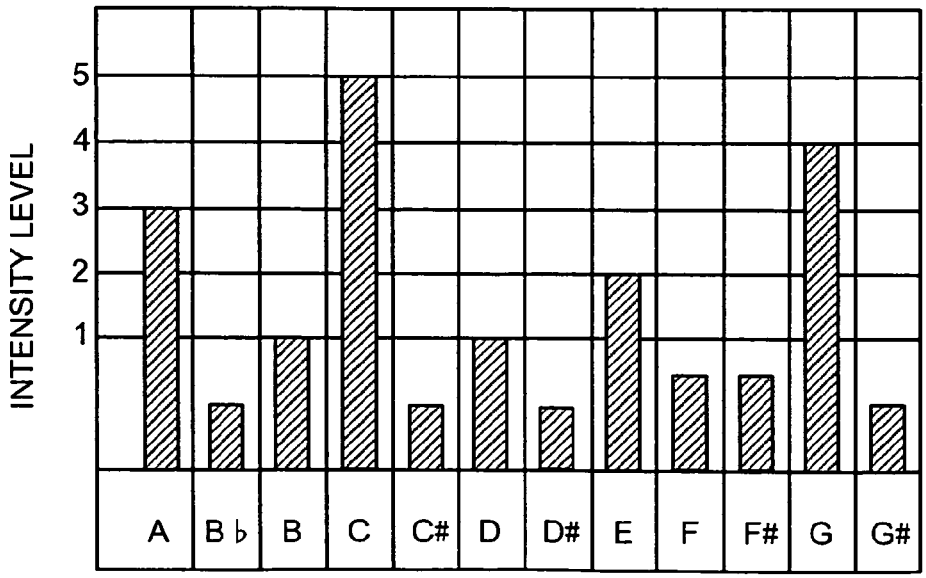
FIG. 19 is an explanatory drawing of a second example of intensity levels with respect to the 12 tones in the band data.

FIG. 19 is an explanatory drawing of a second example of intensity levels with respect to the 12 tones in the band data. When each tone component in the band data F'(T) has a component depicted in FIG. 19, six tones C, G, A, E, B, and D are selected at a step S25. Three chords each generated from three tones in the six tones C, G, A, E, B, and D are, e.g., a chord C including the (tones C, E, and G), a chord Am including (tones A, C, and E), a chord Em including (tones E, B, and G), a chord G including (tones G, B, and D), etc. A total intensity level of the chord C (tones C, E, and G) is 11, chord Am (tones A, C, and E) is 10, a total intensity level of the a total intensity level of the chord Em (tones E, B, and G) is 7, and a total intensity level of the chord G (tones G, B, and D) is 6. Therefore, the chord C is set as the first chord candidate M1 since the total intensity level 11 of the chord C is the maximum at step S26, and the chord Am is set as the second chord candidate M2 since the total intensity level 10 of the chord Am is the second highest.

Figures 20, 21:
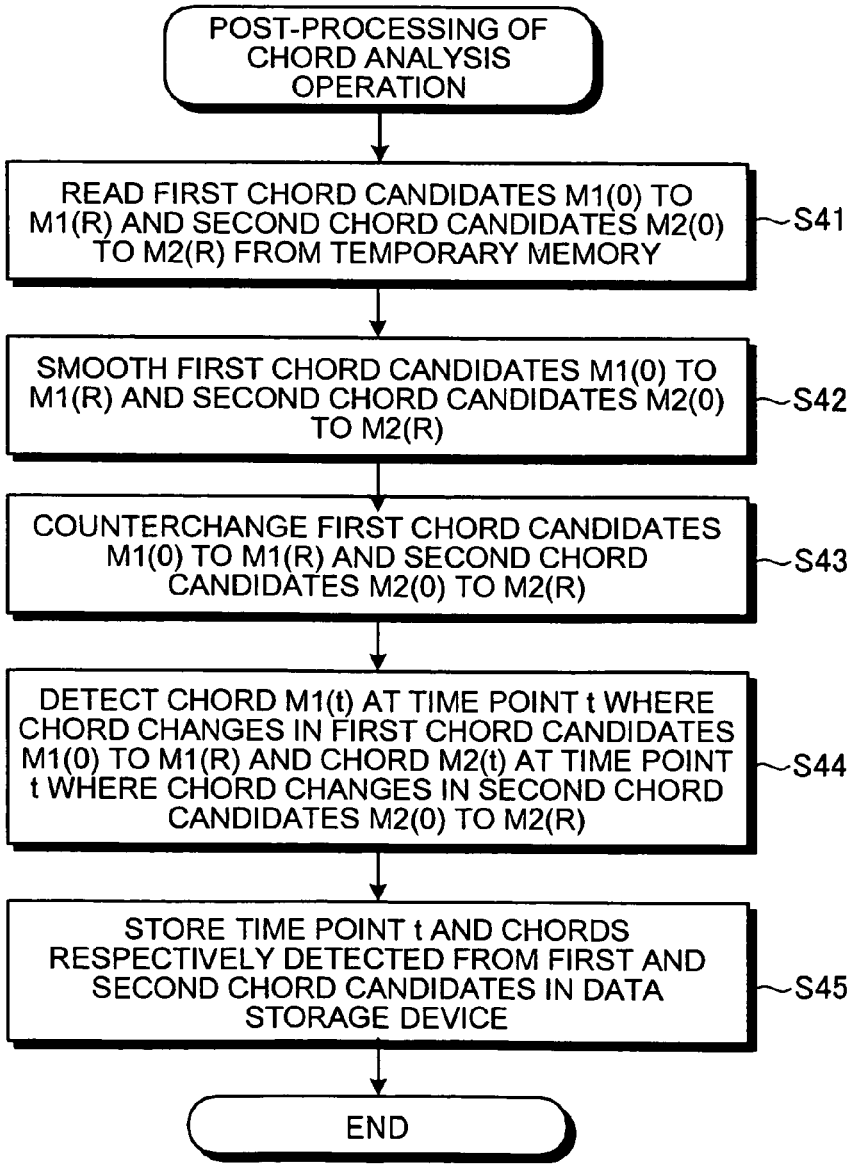
FIG. 20 is an explanatory drawing of conversion from a chord including four tones into a chord including three tones.
FIG. 21 is a flowchart of the post-processing of the chord analysis operation.

FIG. 20 is an explanatory drawing of conversion from a chord including four tones into a chord including three tones. The number of tones constituting a chord is not restricted to three, and may be four like a seventh or a diminished seventh. A chord including four tones is classified into two or more chords each including three tones as depicted in FIG. 20. Therefore, two chord candidates can be set with respect to a chord including four tones according to an intensity level of each tone component in the band data F'(T) like a chord including three tones.

After executing step S26, whether chord candidates whose number is set at step S26 are present is judged (step S27). Since chord candidates are not set at all when there is no difference between intensity levels each obtained by just selecting at least three tones at step S26, the judgment at step S27 is made. When the number of chord candidates>0 (step S27: YES), whether this number of candidates is larger than 1 is further judged (step S28).

When the number of chord candidates=0 is determined at step S27 (step S27: NO), the chord candidates M1 and M2 set in the main processing of previous T−1 (approximately 0.2 second before) are set as the current chord candidates M1 and M2 (step S29). Since the first chord candidate M1 alone is set by current execution of step S26 when the number of chord candidates=1 is determined at step S28 (step S28: NO), the second chord candidate M2 is set to the same chord as the first chord candidate M1 (step S30).

Since both the first and the second chord candidates M1 and M2 are set by current execution of step S26 when the number of chord candidates>1 is determined at step S28 (step S28: YES), a clock time and the first and the second chord candidates M1 and M2 are stored (step S31). At this time, the clock time, the first chord candidate M1, and the second chord candidate M2 are stored as one set. The clock time is indicative of the number of times of executing this processing represented as T that is increased every 0.2 second. The first and the second chord candidates M1 and M2 are stored in the order of T.

Specifically, a combination of a fundamental tone (root) and its attribute is utilized to store each chord candidate by using one byte. Each of 12 tones in an equal temperament is used as the fundamental tone, and a chord type, i.e., a major {4, 3}, a minor {3, 4}, a seventh candidate {4, 6}, or a diminished seventh (dim7) candidate {3, 3} is used as the attribute.

Each number in { } represents a difference between three tones when a half tone is determined as 1. Fundamentally, the seventh candidate has {4, 3, 3} and the diminished seventh (dim7) candidate has {3, 3, 3}, but the expressions are adopted to represent differences by using three tones. When step S29 or S30 is executed, step S31 is also executed immediately after this step.

After executing step S31, whether a tune is finished is judged (step S32). For example, when a digital audio signal is no longer input, or when an operation indicative of end of a tune is input, the tune is determined to be finished. As a result, when the tune is determined to be finished (step S32: YES), the main processing is terminated. 1 is added to the variable T (step S33) and step S21 is again executed until end of the tune is determined (step S32: NO). The step S21 is executed at intervals of 0.2 second as explained above, and it is again executed after elapse of 0.2 second from the previous execution.

FIG. 21 is a flowchart of the post-processing of the chord analysis operation. First, all first and second chord candidates are read as M1(0) to M1(R) and M2(0) to M2(R) (step S41). 0 denotes a start time, and a first and a second chord candidates at the start time are M1(0) and M2(0). R designates an end time, and a first and a second chord candidates at the end time are M1(R) and M2(R). The read first chord candidates M1(0) to M1(R) and the read second chord candidates M2(0) to M2(R) are smoothed (step S42). This smoothing processing is executed to eliminate an error caused due to noise that is included in each chord candidate when the chord candidates are detected at intervals of 0.2 second irrespective of a time point where each chord varies.

After smoothing, the first and the second chord candidates M1(0) to M1(R) and M2(0) to M2(R) are counterchanged (step S43). In general, a possibility that each chord varies is low in a short period like 0.6 second. However, the first and the second chord candidates may be counterchanged within 0.6 second when a frequency of each tone component in the band data F'(T) fluctuates due to frequency characteristics of a signal input stage and noise at the time of input of a signal, and the counterchanging processing is executed to cope with this phenomenon.

Figure 22:
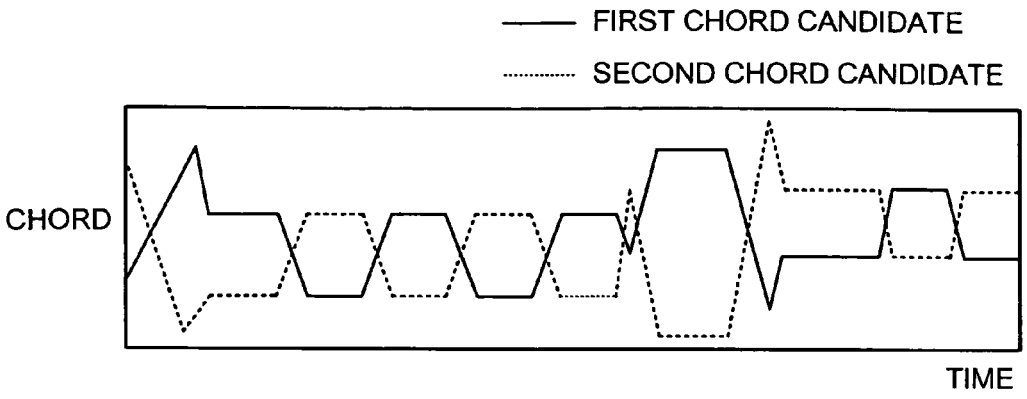
FIG. 22 is an explanatory drawing of a change in a chord candidate over time before the smoothing processing.

FIG. 22 is an explanatory drawing of a change in a chord candidate over time before the smoothing processing. An example where each chord in the first chord candidates M1(0) to M1(R) and the second chord candidates M2(0) to M2(R) read at step S41 changes with time as depicted in FIG. 22 will be explained. Each chord is corrected as depicted in FIG. 23 by performing the smoothing processing at step S42.

Figure 23:
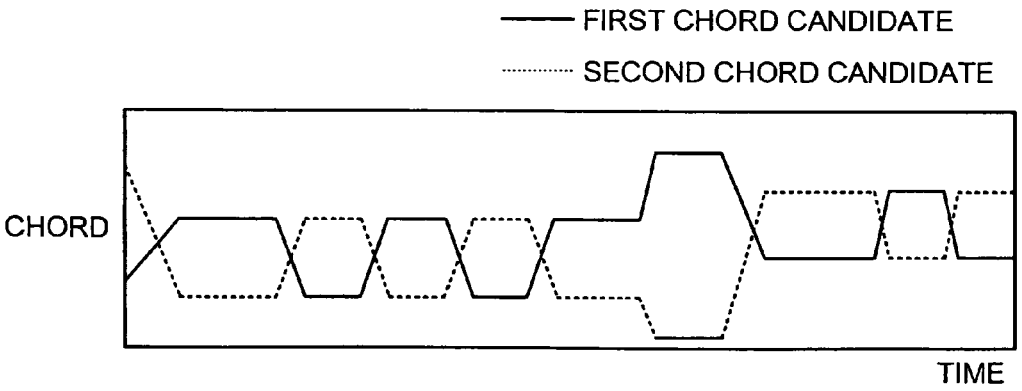
FIG. 23 is an explanatory drawing of a change in each chord candidate over time after the smoothing processing.
Figure 24:
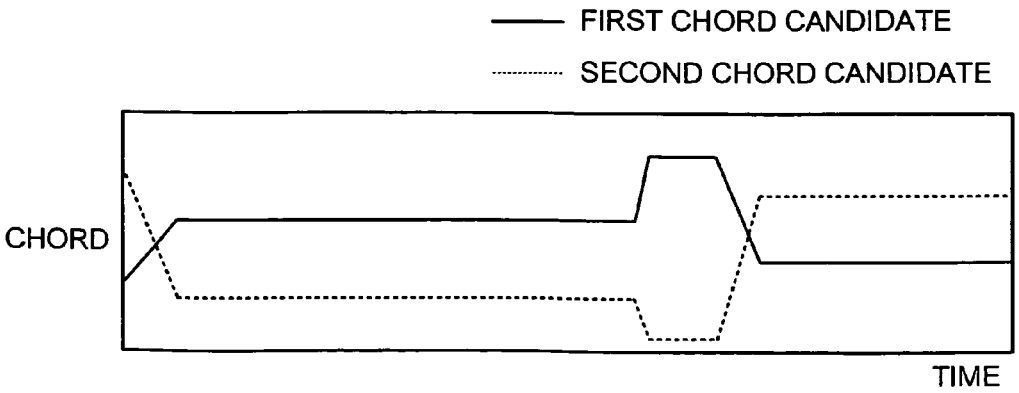
FIG. 24 is an explanatory drawing for explaining a change in each chord candidate with time after the counterchanging processing.

FIG. 23 is an explanatory drawing of a change in each chord candidate over time after the smoothing processing. Counterchanging each chord at step S43 enables correcting a change in each chord of the first and the second chord candidates as depicted in FIG. 24. FIG. 24 is an explanatory drawing for explaining a change in each chord candidate with time after the counterchanging processing. Each of FIGS. 22 to 24 depicts a change in each chord over time in the form of a line graph, and an ordinate represents a position corresponding to chord type.

A chord M1(*t*) at a time point t where the chord varies in the first chord candidates M1(0) to M1(R) and a chord M2(*t*) at the time point t where the chord varies in the second chord candidates M2(0) to M2(R) after the chord counterchanging processing at step S43 are respectively detected (step S44), and the detected time point t (four bytes) and each chord (four bytes) are stored with respect to each of the first and the second chord candidates (step S45). Data corresponding to one tune stored at step S45 is chord progression tune data.

Figure 25:
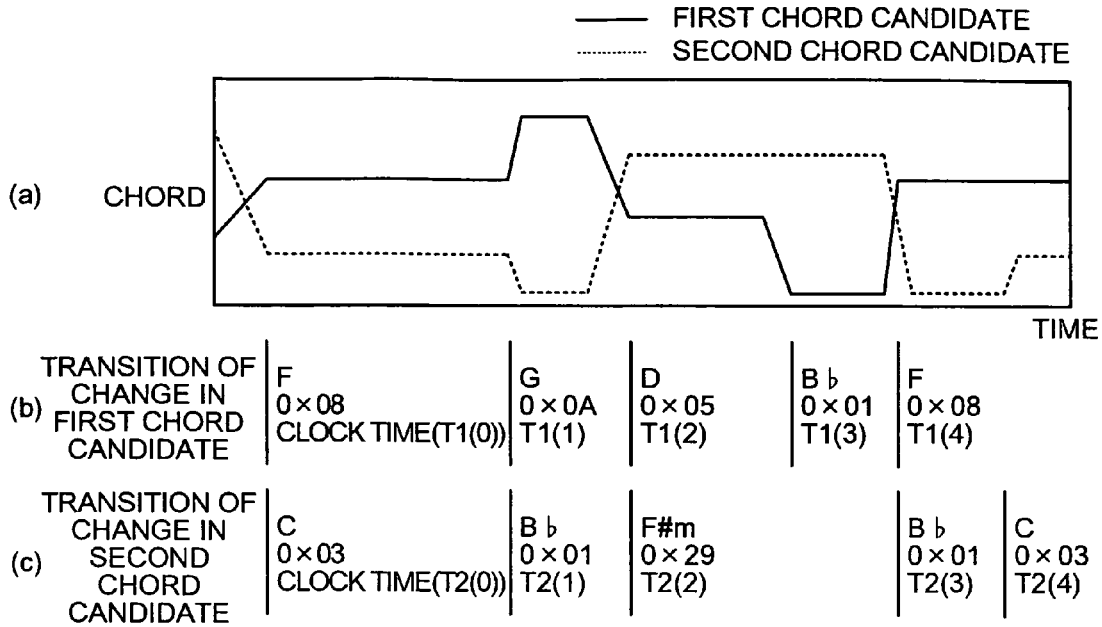
FIG. 25 is an explanatory drawing of a chord progression tune data generating method and a format thereof

FIG. 25 is an explanatory drawing of a chord progression tune data generating method and a format thereof. As shown in this drawing, when the chords in the first chord candidates and the second chord candidates after the chord counterchanging processing at step S43 change with time as shown in FIG. 25(*a*), each clock time and each chord at the time point of the change are extracted as data. FIG. 25(*b*) depicts data contents at the time point of the change in the first chord candidates, F, G, D, B♭, and F are chords, and they are represented as 0x08, 0x0A, 0x05, 0x01, and 0x08 as hexadecimal data. Clock times at the time point t of the change are T1(0), T1(1), T1(2), T1(3), and T1(4). FIG. 25(*c*) depicts data contents at a time point of the change in the second chord candidates, C, B♭, F#m, B♭, and C are chords, and they are represented as 0x03, 0x01, 0x29, 0x01, and 0x03 as hexadecimal data. Clock times at the time point t of the change are T2(0), T2(1), T2(2), T2(3), and T2(4).

A first and a second chord sequences are determined by the chord analysis processing, and these sequences can be used to extract progression of chords, thereby detecting a change in the chord progression. At this time, when an add-tone is combined to reproduce the tune, the arousing effect can be obtained.

According to the embodiment explained above, an add-tone can be combined with a tune to be reproduced according to a change in chord progression. Tones having a high arousing effect can be simultaneously output. As a result, the arousing effect can be obtained with a comfortable sound stimulus, an arousal maintaining effect can be acquired in an environment where a user is listening to music. Therefore, tones having the high arousing effect can be output without degrading the music, thereby warding off drowsiness in a pleasant environment. Any music can be used, a user can obtain the arousing effect without becoming bored. Since a combined tone to be added is reproduced at a time when the chord progression changes, a sense of tension can be obtained while minimizing discomfort.

Tones having a high arousing effect are output while changing sound localization without degrading the music creating a pleasant environment, and drowsiness can be warded off in the pleasant environment. Changing the sound image position and/or moving the sound image position enables enhancing the arousing effect. Any music can be used when changing the combined tone and the sound image position, and hence a user can obtain the arousing effect without becoming bored.

This tune reproduction apparatus can not only alleviate drowsiness during driving, but can also ward off drowsiness in children studying at home when adopted for domestic use. This apparatus can be also used in trains or buses in a mass transit system. Additionally, since drowsiness can be warded off while listening to one's favorite music, the added function of the tune reproduction apparatus can be utilized in extensive fields.

The invention claimed is:

1. A tune reproduction apparatus comprising:

an extracting unit that extracts chord progression of a tune to be reproduced;

a first detecting unit that detects a timing of variation of the chord progression extracted by the extracting unit; and an add-tone reproducing unit that reproduces, according to the timing detected by the first detecting unit, sound in which an add-tone is combined with the tune, and changes a sound image of the add-tone when the sound is reproduced.

2. The tune reproduction apparatus according to claim 1, further comprising an add-tone generating unit that generates the add-tone by changing a pitch thereof according to the chord progression extracted by the extracting unit, wherein the add-tone generated by the add-tone generating unit is combined with the tune.

3. The tune reproduction apparatus according to claim 1, wherein the add-tone reproducing unit reproduces the add-tone as an arpeggio.

4. The tune reproduction apparatus according to claim 1, further comprising a second detecting unit that detects a state of drowsiness, wherein the add -tone reproducing unit starts reproducing the add-tone when the second detecting unit detects the state of drowsiness.

5. The tune reproduction apparatus according to claim 1, further comprising a second detecting unit that detects a state of drowsiness, wherein the add -tone reproducing unit changes frequency characteristics of the add-tone when the second detecting unit detects that the state of drowsiness has intensified.

6. The tune reproduction apparatus according to claim 1, further comprising a second detecting unit that detects a state of drowsiness, wherein the add-tone reproducing unit changes an amount of displacement of the sound image when the second detecting unit detects that the state of drowsiness has intensified.

7. A tune reproduction method comprising:

extracting chord progression of a tune to be reproduced;

detecting a timing of variation of the chord progression extracted at the extracting; and reproducing, according to the timing detected by the detecting, sound in which an add-tone is combined with the tune, and changing a sound image of the add-tone when the sound is reproduced.

8. The tune reproduction method according to claim 7, further comprising generating an add-tone by changing a pitch thereof according to the chord progression extracted at the extracting, wherein the add-tone generated at the generating is combined with the tune.

9. The tune reproduction method according to claim 7, wherein the reproducing includes reproducing the add-tone as an arpeggio.

10. The tune reproduction method according to claim 7, further comprising detecting a state of drowsiness, wherein the reproducing includes initiating reproducing the add-tone when the state of drowsiness is detected at the detecting the state of drowsiness.

11. The tune reproduction method according to claim 7, further comprising detecting a state of drowsiness, wherein the reproducing includes changing frequency characteristics of the add-tone when, at the detecting the state of drowsiness, the state of drowsiness is detected to have intensified.

12. The tune reproduction method according to claim 7, further comprising detecting a state of drowsiness, wherein the reproducing includes changing an amount of displacement of the sound image when, at the detecting the state of drowsiness, the state of drowsiness is detected to have intensified.

* * * * *